US009339161B2

(12) United States Patent
McLuckie et al.

(10) Patent No.: US 9,339,161 B2
(45) Date of Patent: May 17, 2016

(54) UPRIGHT VACUUM CLEANER

(71) Applicant: Dyson Technology Limited, Wiltshire (GB)

(72) Inventors: Paul Andrew McLuckie, Wiltshire (GB); Charles Edward Park, Wiltshire (GB); James Dyson, Wiltshire (GB); Peter David Gammack, Wiltshire (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 719 days.

(21) Appl. No.: 13/629,024

(22) Filed: Sep. 27, 2012

(65) Prior Publication Data

US 2013/0081226 A1 Apr. 4, 2013

(30) Foreign Application Priority Data

Sep. 29, 2011 (GB) ..... 1116806.9

(51) Int. Cl.
*A47L 5/32* (2006.01)
*A47L 9/24* (2006.01)

(52) U.S. Cl.
CPC . *A47L 9/244* (2013.01); *A47L 5/32* (2013.01); *Y10T 16/473* (2015.01)

(58) Field of Classification Search
CPC ..... A47L 9/244; A47L 5/36; A47L 5/32; A47L 5/225; Y10T 16/473
USPC ..... 15/331, 334, 335, 410, 329, 328; 285/7, 285/303
See application file for complete search history.

(56) References Cited

U.S. PATENT DOCUMENTS 2,867,833 A * 1/1959 Duff ..... 15/323
3,351,363 A * 11/1967 Downey ..... A47L 9/244 285/303
5,046,761 A * 9/1991 Cordes ..... A47L 9/244 285/119
5,593,239 A * 1/1997 Sallee ..... E04H 12/182 135/114

(Continued)

FOREIGN PATENT DOCUMENTS

AT WO9935409 * 1/1999 ..... A47L 9/00
DE EP0552481 * 12/1992 ..... A47L 9/24

(Continued)

OTHER PUBLICATIONS

International Search Report and Written Opinion mailed Dec. 18, 2012, directed to International Application No. PCT/GB2012/052242; 11 pages.

(Continued)

*Primary Examiner* — Joseph J Hail
*Assistant Examiner* — Arman Milanian
(74) *Attorney, Agent, or Firm* — Morrison & Foerster LLP

(57) ABSTRACT

An upright vacuum cleaner comprising a telescopic suction wand fluidly connected to a separating apparatus on the cleaner via a hose and which is used, as required, to clean above the level of the floor. The wand comprises a lower wand section, an upper wand section telescopically mounted to the lower wand section and a moveable locking member which, when the wand is released for use, is biased towards a locking position for locking out the wand sections in telescopic extension. The locking member is releasable from this locking position via a reaction member provided on the cleaner, against which reaction member a user may readily force the biased locking member out of the locking position using the locked-out wand.

13 Claims, 23 Drawing Sheets

(56) References Cited

U.S. PATENT DOCUMENTS

| | | | | |
|---|---|---|---|---|
| 5,740,583 | A * | 4/1998 | Shimada | A47L 9/244 15/377 |
| 6,148,474 | A | 11/2000 | Ohara et al. | |
| 6,435,754 | B1 * | 8/2002 | Canale | A47L 9/244 403/109.2 |
| 6,442,791 | B1 * | 9/2002 | McRae Thomson et al. | 15/334 |
| 6,494,492 | B1 * | 12/2002 | Ha | A47L 9/244 285/303 |
| 6,513,191 | B1 * | 2/2003 | Kim | A47L 9/244 15/414 |
| 6,565,123 | B2 * | 5/2003 | Schiemann | A47L 9/244 285/302 |
| 7,036,183 | B2 | 5/2006 | Gammack et al. | |
| 7,516,988 | B2 * | 4/2009 | Lin | A47L 9/244 15/414 |
| 8,272,098 | B2 * | 9/2012 | Stewart | 15/414 |
| 8,336,164 | B2 | 12/2012 | Coleman et al. | |
| 2003/0024066 | A1 * | 2/2003 | Kennedy | A47L 9/244 15/322 |
| 2007/0209152 | A1 | 9/2007 | Pullins et al. | |
| 2009/0038111 | A1 | 2/2009 | White et al. | |
| 2009/0038112 | A1 * | 2/2009 | Wood | A47L 5/225 15/410 |
| 2010/0251517 | A1 * | 10/2010 | Lai | A45C 13/262 16/113.1 |
| 2011/0088213 | A1 | 4/2011 | Coleman et al. | |
| 2013/0081222 | A1 | 4/2013 | Wills et al. | |
| 2013/0081225 | A1 | 4/2013 | McLuckie et al. | |

FOREIGN PATENT DOCUMENTS

| | | | | |
|---|---|---|---|---|
| DE | 195 47 722 | | 1/1997 | |
| DE | 10 2009 026 748 | | 12/2010 | |
| EP | 1 121 043 | | 8/2001 | |
| EP | 2 042 072 | | 4/2009 | |
| EP | 2 133 018 | | 12/2009 | |
| GB | 2 416 296 | | 1/2006 | |
| GB | 2 440 718 | | 2/2008 | |
| GB | 2 451 679 | | 2/2009 | |
| GB | 2 451 680 | | 2/2009 | |
| GB | 2 455 811 | | 6/2009 | |
| GB | 2 474 477 | | 4/2011 | |
| JP | 2000-37329 | | 2/2000 | |
| JP | 2001-112679 | | 4/2001 | |
| JP | 2008-80043 | | 4/2008 | |
| JP | 2008-161503 | | 7/2008 | |
| JP | 2009-39543 | | 2/2009 | |
| JP | 2011-19944 | | 2/2011 | |
| KR | WO0067631 | * | 5/1999 | A47L 9/24 |
| WO | WO-99/35409 | | 7/1999 | |

OTHER PUBLICATIONS

Search Report mailed Jan. 30, 2012, directed to GB Application No. 1116806.9; 1 page.

McLuckie et al., U.S. Office Action mailed Jun. 26, 2014, directed to U.S. Appl. No. 13/631,181; 7 pages.

* cited by examiner

UPRIGHT VACUUM CLEANER

REFERENCE TO RELATED APPLICATIONS

This application claims the priority of United Kingdom Application No. 1116806.9 filed 29 Sep. 2011, the entire contents of which are incorporated herein by reference.

FIELD OF INVENTION

The present invention relates generally to upright vacuum cleaners, which includes dry, wet or "wet-and-dry" upright vacuum cleaners.

BACKGROUND OF INVENTION

Upright cleaners typically have a rolling head assembly, which carries a fixed cleaner head in plane-parallel contact with the floor surface. This head assembly is mounted on a reclining 'upright' body which carries a handle at its upper end. In the conventional floor-cleaning mode, a user reclines the 'upright' body until the handle is at a convenient height, and then uses the handle manually to push the cleaner across the floor, maintaining the cleaner head in plane parallel contact with the floor surface.

It is often desirable to vacuum-clean above the level of a floor. For example, it may be desirable to vacuum-clean shelving, stairs or the upper corners of a room. It is usually completely impractical to use the main cleaner head for this purpose: the cleaner will almost certainly be too heavy and cumbersome, and the cleaner head itself too large. Instead, many modern upright vacuum cleaners are provided with a suction wand which connects to the main separating apparatus onboard the vacuum cleaner via a flexible hose. This wand and hose assembly allows the upright vacuum cleaner to be operated, as required, in the manner of a cylinder (or "canister") vacuum cleaner—making "above the floor cleaning" much more practical.

For convenience, the wand is normally stored on-board the vacuum cleaner. FIGS. 1 and 2 illustrate one example of this sort of arrangement, as used on the DC14 and DC15 models of Dyson upright vacuum cleaner. Here, the wand 1 is connected to the hose 3 via the main handle 5 on the cleaner 7, which releases with the wand 1 so that it can double-up as a wand handle when the wand 1 is being used (FIG. 2). The handle 5 is fixed to the upper end of the hose 3, but telescopically receives the wand 1 so that the wand 1 can be fully extended in use and then subsequently retracted inside the hose 3 for compact storage on the cleaner 7. A manual-release catch 9 secures the handle 5 to the cleaner 7 until such time as it is required to use the wand 1.

SUMMARY OF THE INVENTION

The present invention seeks to provide an improved wand and hose assembly on an upright vacuum cleaner.

According to the present invention, there is provided an upright vacuum cleaner comprising a telescopic suction wand fluidly connected to a separating apparatus on the cleaner via a hose and which is used, as required, to clean above the level of the floor, the wand comprising a lower wand section, an upper wand section telescopically mounted to the lower wand section and a moveable locking member which, when the wand is released for use, is biased towards a locking position for locking out the wand sections in telescopic extension, the locking member being releasable from this locking position via a reaction member provided on the cleaner, against which reaction member a user may readily force the biased locking member out of the locking position using the locked-out wand.

Thus, the user can conveniently release the wand sections simply by manipulating the locked-out wand against the reaction member on the cleaner—there is no requirement for the user to reach for any separate manual catch to unlock the wand sections. This provides a very "user-friendly" and intuitive arrangement for releasing the telescopic wand. At the same time, the telescopic wand provides for compact storage of the wand on the cleaner.

The wand may arranged to retract inside the hose—further promoting compact storage of the wand and hose assembly onboard the cleaner—and the reaction member may form part of an inlet duct assembly fluidly connecting the base of the hose to the separating apparatus, the locking member being arranged to force against the reaction member during normal retraction of the lower wand section inside the hose. In this arrangement, the release of the wand sections is integrated as part of normal retraction of the wand: the user simply needs to retract the wand inside the hose—as the user would do ordinarily to store the wand—and the wand sections are then released automatically during said retraction, via cooperation of the locking member and reaction member.

The locking member may cooperate with a first locking feature on the upper wand section to lock out the wand sections in telescopic extension. This locking feature may take various forms. For example, it may be in the form of a catch recess, in which case the locking member may co-operate with the catch recess via an intermediate catch member, such as a floating ball-catch or roller-catch held captive between the locking member and the catch recess.

The locking member may conveniently be a sliding locking member, which may be mounted on the lower wand section for axial sliding movement between said locking position and a release position. The use of an axial sliding locking member on the lower wand section—as opposed, say, to a pivoting locking member—provides for a slim-line wand which can be accommodated easily inside the hose for storage.

In a particular embodiment, the locking member engages the reaction member via an elongate, axially-sliding push rod mounted on the lower wand section. This allows the locking member to be positioned remote from the reaction member. For example, the reaction member may be provided as part of the inlet duct assembly, but the locking member need not be provided near to the inlet assembly: it could be spaced from the reaction member, at the upper end of the lower wand section. This provides for greater flexibility in the overall design.

The locking member may be formed integrally with the push rod.

The locking member may be hidden away from the user inside a wand catch-housing. This helps prevent a user from interfering with operation of the locking member, or incorrectly operating the locking member.

Similarly, the push rod may be hidden away from the user in between the two wand sections. For example, the lower wand section may be generally cylindrical and the upper wand section may have a generally D-shaped cross section to define an axial channel between the two wand sections, the push rod then extending down inside this channel.

In one possible arrangement according to the invention, the wand sections are keyed to one another so that the wand acts as a torsion brace between the handle assembly and the inlet duct assembly. The wand is thus "dual-purpose", combining both the primary cleaning function of the wand with a secondary structural function when the wand is being stored.

This advantageously removes some of the structural design constraints on upright body of the appliance, allowing for example a reduction in weight and essential "like-for-like" material costs.

It is preferable that the use of the wand as a structural brace does not interfere with convenient storage and deployment of the wand for use. In a preferred arrangement therefore, the lower wand section and the inlet duct assembly are arranged for axial sliding engagement to key the lower wand section to the inlet duct assembly. This integrates the functionality of the stored wand as a structural brace with a simple sliding retraction and extension of the lower wand section for ease of storage and deployment.

In one embodiment, the wand comprises a second locking feature for co-operating with the locking member, this second locking feature being positioned on the upper wand section above the first locking feature such that when the handle is in the raised position, the locking member in its release position sits axially between the first and second locking features, the relative axial position of the locking member and the second locking feature being such that sliding the upper wand upwards engages the locking member with the second locking feature before the lower wand section can slide out of keying engagement with the inlet duct assembly. Thus, if the user accidentally knocks upwards against the lower wand section—which lower wand section may extend above the upper end of the hose even when it is retracted inside the hose—upward movement of the lower wand section is advantageously arrested before the lower wand section can slide out of keying engagement with the inlet duct assembly—ensuring that the function of the wand as a torsion brace is maintained.

In a particular embodiment, the cleaner may have a slide retractable handle which is used in a floor-cleaning mode to manoeuvre the cleaner across the floor, the upper telescopic section of the wand being releasably connected with a sliding handle assembly incorporating the handle, and the lower telescopic section of the wand being releasably connected to some other part of the cleaner so that sliding extension and retraction of the handle assembly relative to that other part of the cleaner effects telescopic extension and retraction of the wand sections.

This particular arrangement has the benefit that both the handle and wand are retractable for compact storage when the cleaner is not in use. The handle assembly and the wand are arranged so that the wand effectively extends and retracts in sympathy with the handle when it is being stored on the cleaner. This brings the additional benefit that when the handle is extended for use, the wand is likewise extended automatically; similarly, when the handle is returned to the compact storage position, the wand likewise automatically returns to its compact storage position. The wand and handle assembly do not get out of sync, so the user is not burdened with having to extend and retract the wand and handle assembly independently.

The upper wand section and the handle assembly may conveniently be arranged for axial sliding engagement to connect the upper wand section to the handle assembly. In this manner, the upper wand section can effectively engage the handle assembly by "hooking" the upper wand section onto the handle assembly.

In one arrangement, the upper wand section locks to the handle assembly via a catch member on the handle assembly, which catch member is biased towards a locking position for locking engagement with a cooperating catch feature on the upper wand section. This holds the upper wand section securely on the handle assembly.

The upper wand section may be unlocked from the handle assembly via an axially-sliding release member mounted on the upper wand section, this release member being arranged for manual sliding engagement with the catch member to force the catch member out of its locking position for disengaging the wand.

The release member may be mounted specifically for upward sliding engagement with the catch member, in which case the release member may top out on a stop on the upper wand section. Thus, the sliding action of the release member is the same upward sliding action required to disengage the wand from the handle assembly. The consistent use of a sliding action both to unlock and then release the wand is more intuitive to the user than if various different actions were required in order to deploy the wand. Indeed, if the release member is arranged to top out on the upper wand section, a single continuous sliding action can be used both to unlock the upper wand section and to disengage the wand from the handle assembly.

A biasing member may be provided to bias the release member away from the catch member—effectively holding the release member away from the catch member until such time as the release member is manually engaged with the catch member. This helps prevent accidental unlocking of the upper wand section, without interfering with the simple sliding release operation of the release member.

The release member itself may be in the form of a slide-mounted sleeve on the upper wand section, though this is not essential.

In other embodiments, the cleaner may additionally comprise a hose catch provided at the end of the hose, the hose catch being biased towards a locking position in which the hose catch locks the wand in an extended position, the hose being a stretch hose arranged, in its coil-bound state, to act as a reaction member against which a user may readily force the biased hose catch out of said locking position using the extended wand. Thus, the biased hose catch operates automatically to lock the extended wand in use. Then, when it is required to retract the wand inside the hose for storage, the extended wand can simply manipulate the wand against the coil bound hose automatically to release the extended wand for retraction. There is no requirement for the user to reach for any separate manual catch in order to release the wand.

The coil-bound hose may be arranged to react against the hose catch via a guide part fixed to the end of the hose, this guide part slidably engaging the hose catch along the axis of retraction of the wand. In this sort of arrangement, release of the hose catch requires the wand to be forced axially against the coil bound hose—which has the benefit that the same action is used both to release the hose catch and retract the hose, effectively integrating wand release and retraction into a single operation.

The guide part may engage the hose catch via a ramp surface for forcing the biased hose catch out of the locking position, though this is not essential.

BRIEF DESCRIPTION OF THE DRAWINGS

Embodiments of the invention will now be described, by way of example, with reference to the accompanying Figures, in which.

DETAILED DESCRIPTION OF THE INVENTION

Figure 1:
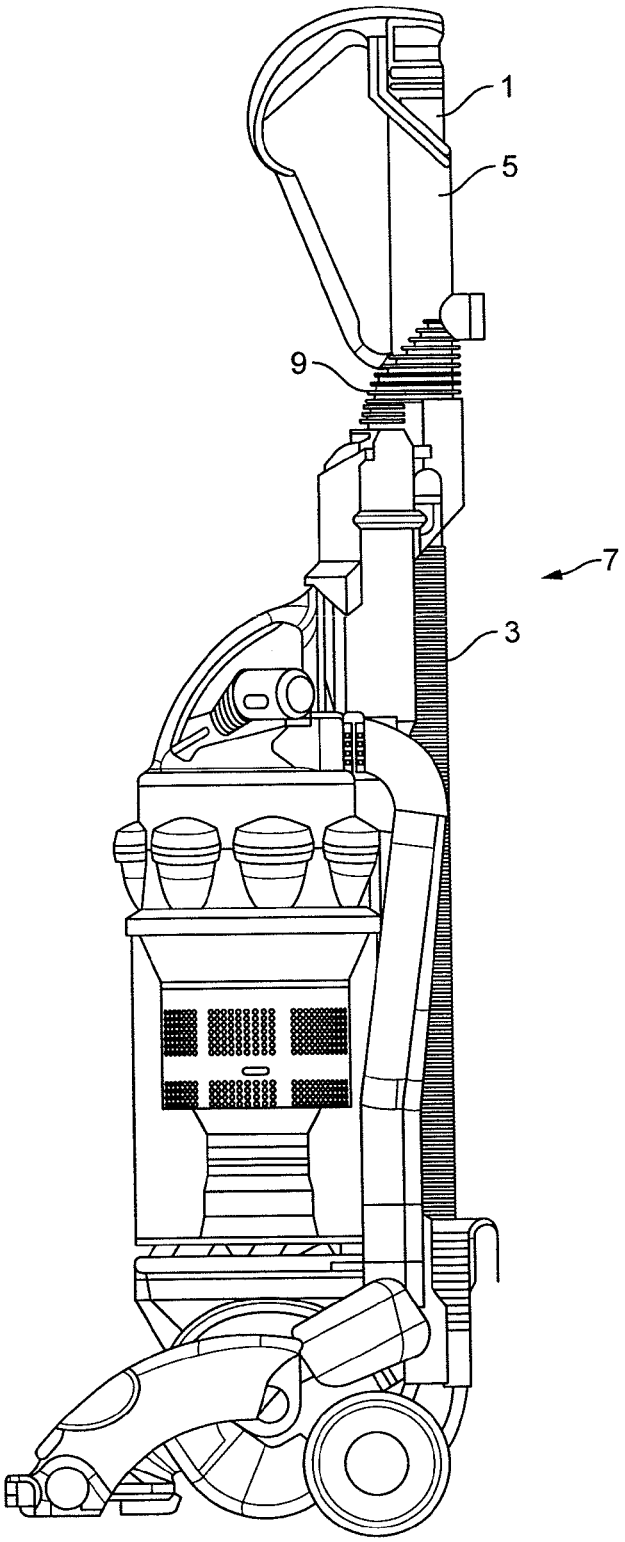
FIG. 1 PRIOR ART
FIG. 1 is a perspective view of an upright vacuum cleaner incorporating a conventional hose and wand assembly.
Figure 2:
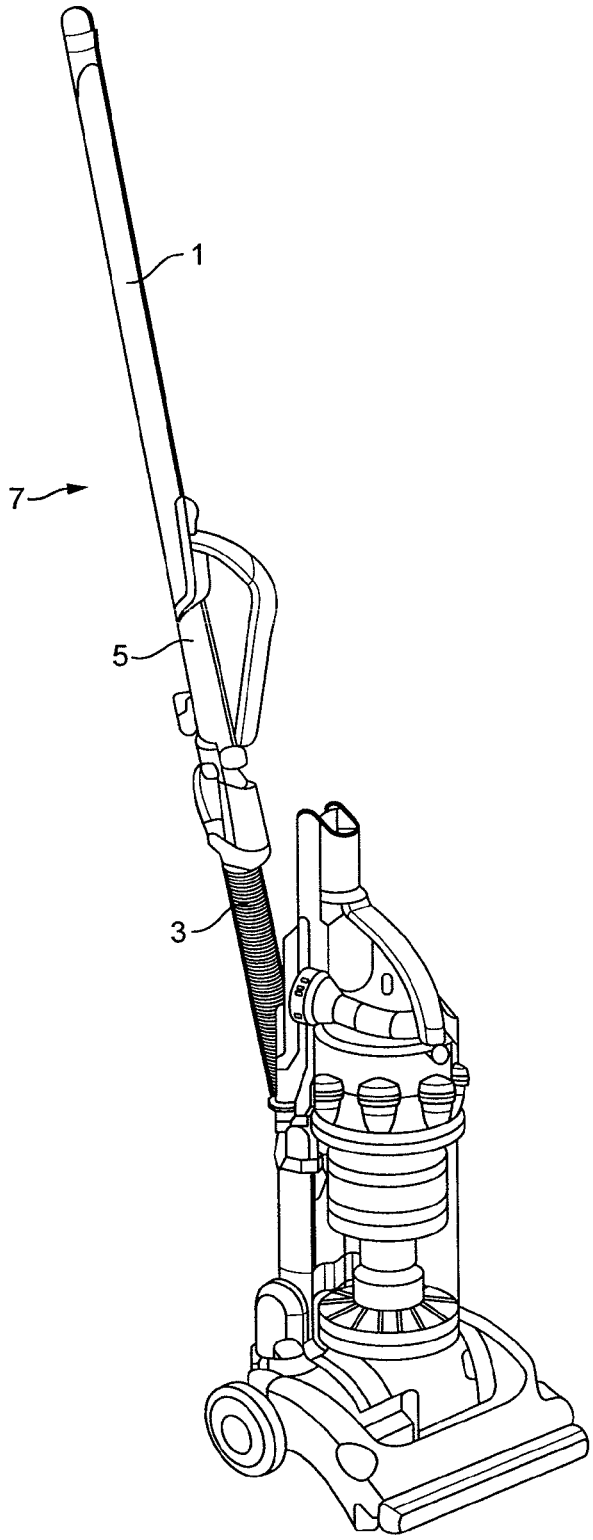
FIG. 2 PRIOR ART
FIG. 2 is a perspective view of the upright vacuum cleaner shown in FIG. 1, with the wand deployed for use.
Figure 3:
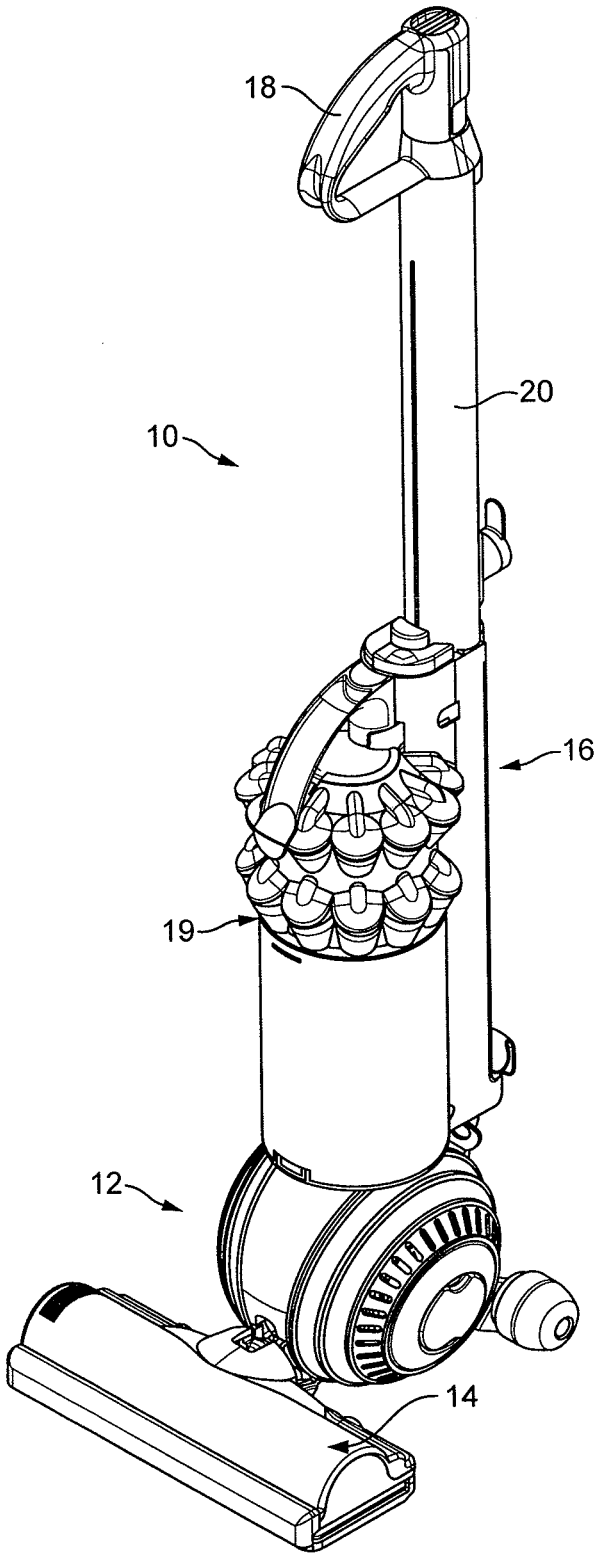
FIG. 3 is a perspective view of an upright vacuum cleaner incorporating a hose and wand assembly in accordance with the present invention.

FIG. 3 shows an upright vacuum cleaner 10.

The cleaner 10 has a rolling head assembly 12 which carries a fixed cleaner head 14, and an 'upright' body 16 which can be reclined relative to the head assembly 12 and which includes a handle 18 for manouevring the cleaner 10 across the floor. In use, a user grasps the handle 18 and reclines the upright body 16 until the handle 18 is disposed at a convenient height for the user; the user can then roll the vacuum cleaner 10 across the floor using the handle 18 in order to pick up dust and other debris on the floor. The dust and debris is drawn in through a downward-facing suction inlet on the cleaner head 14 by a motor-driven fan housed on-board the cleaner 10. From here, the dirt-laden air stream is ducted in conventional manner under the fan-generated suction pressure to a cyclonic separating apparatus 19, where dirt is separated from the air before the relatively clean air is then expelled back to the atmosphere.

Figure 4:
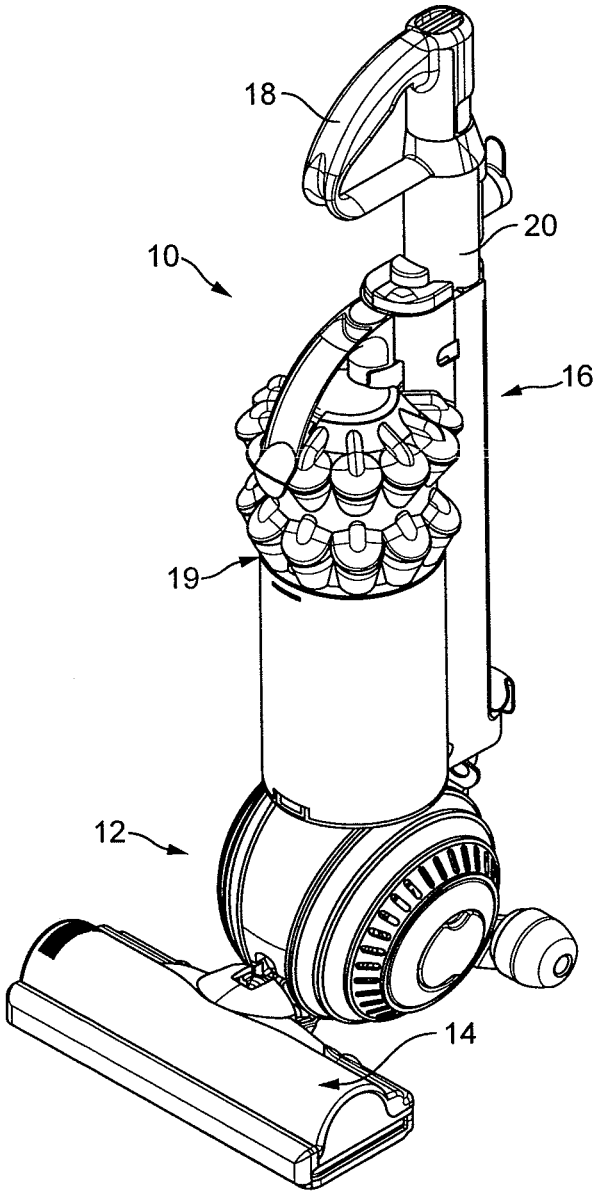
FIG. 4 is a perspective view of the upright vacuum cleaner in FIG. 4, but placed in a compact storage configuration.

The handle 18 forms part of a handle assembly 20, which also includes an elongate stem for supporting the handle. The entire handle assembly 20 is slide-retractable for compact storage when the cleaner is not in use, as shown in FIG. 4.

Figure 5:
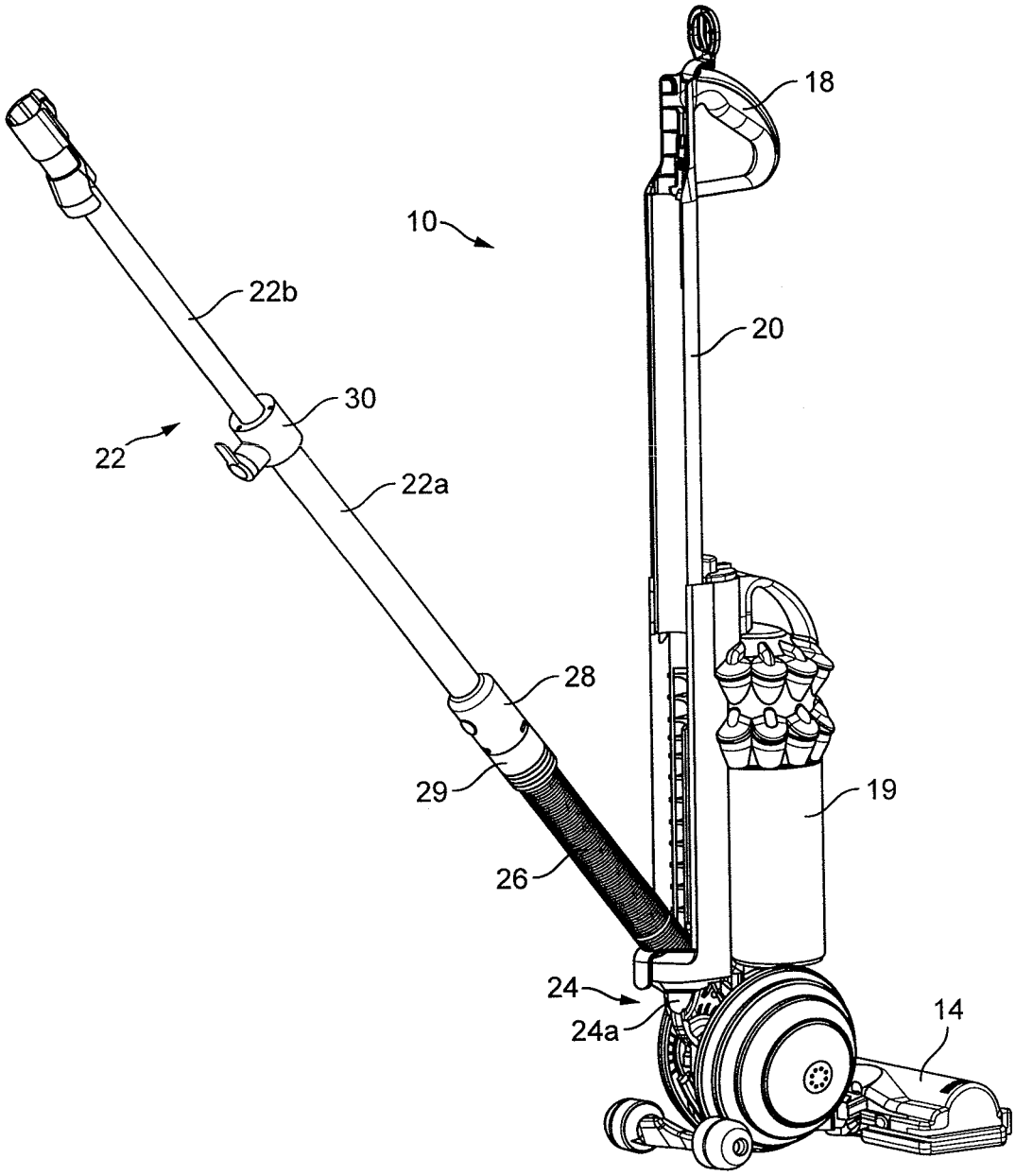
FIG. 5 is a rear perspective view of the upright vacuum cleaner in FIGS. 3 to 5, with the wand deployed for use.

The cleaner additionally incorporates a hose and wand assembly which can be deployed for above-the-floor cleaning, as shown in FIG. 5. This hose and wand assembly comprises a suction wand 22 which is connected to an inlet duct assembly 24 on the cleaner via a flexible hose 26. The inlet duct assembly 24 comprises an inlet duct 24*a* which connects the hose to the negative pressure side of the main vac-motor (not visible in the drawings). Connection may be via a so-called "changeover" valve which operates selectively to connect either the inlet duct 24*a* or the cleaner head 14 to the vac-motor, depending upon whether the cleaner 10 is in a floor cleaning mode or an "above-the floor" cleaning mode. An example of a conventional changeover valve arrangement for a vacuum cleaner is described in European Patent No. EP1121043B1. When the inlet duct 24*a* is connected to the vac-motor, air is drawn in through the suction wand 22, from where it is ducted to the separating apparatus 19 on the cleaner 10, via the hose 26.

Figure 6:
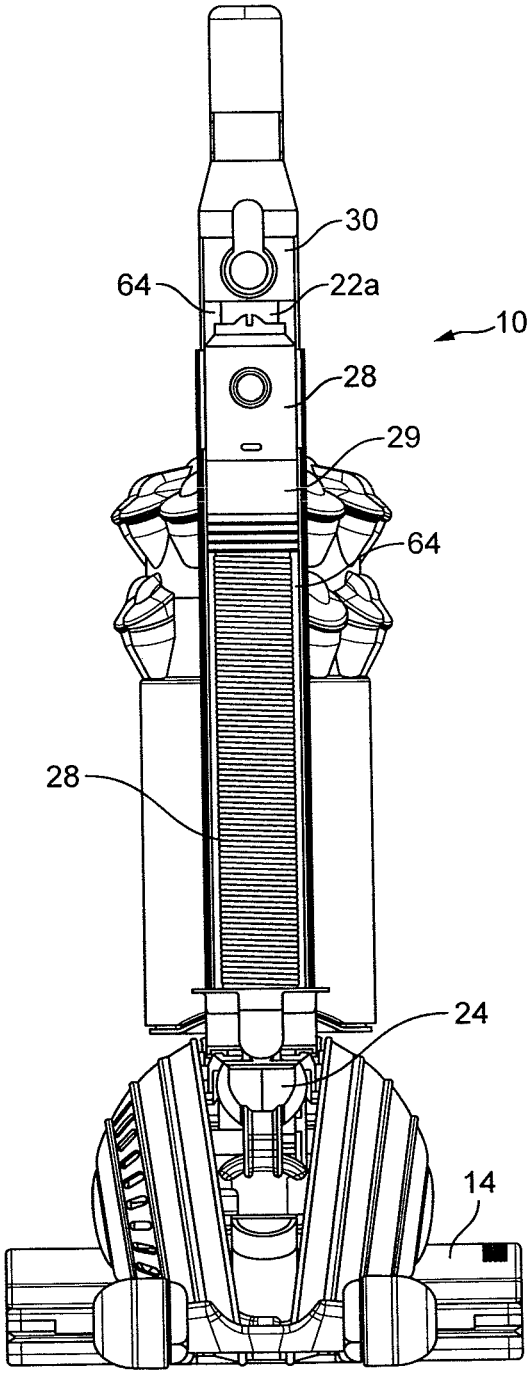
FIG. 6 is a rear view corresponding to FIG. 4, again showing the vacuum cleaner in a compact storage configuration.

The wand 22 and hose 26 are conveniently stored onboard the cleaner 10 when not in use. The relative length of the wand 22, combined with the upright configuration of the cleaner 10, makes it convenient to store the wand 22 in a generally 'upright' orientation on the back of the reclining body 16. Nevertheless, the operational length of the wand 22 cannot easily be accommodated onboard the cleaner 10—particularly if the sliding handle assembly 20 is in the retracted position as this reduces the overall height of the cleaner 10. To address this problem, the wand 22 is designed as a two-part telescopic wand, which is additionally arranged to retract inside the hose 26 for storage, as shown in FIG. 6 (a rear view corresponding to FIG. 4). This significantly reduces the storage length of the wand and hose assembly.

In use, retraction of the wand 22 inside the hose 26 is prevented by a hose catch assembly 28, which locks a first, hereafter "lower", telescoping section 22*a* in the extended position shown in FIG. 5. Similarly, telescopic retraction of the wand itself is prevented during use by a wand catch assembly 30, which locks the lower telescoping part 22*a* of the wand 22 to a second, hereafter "upper", telescoping section 22*b* of the wand 22.

Figure 7:
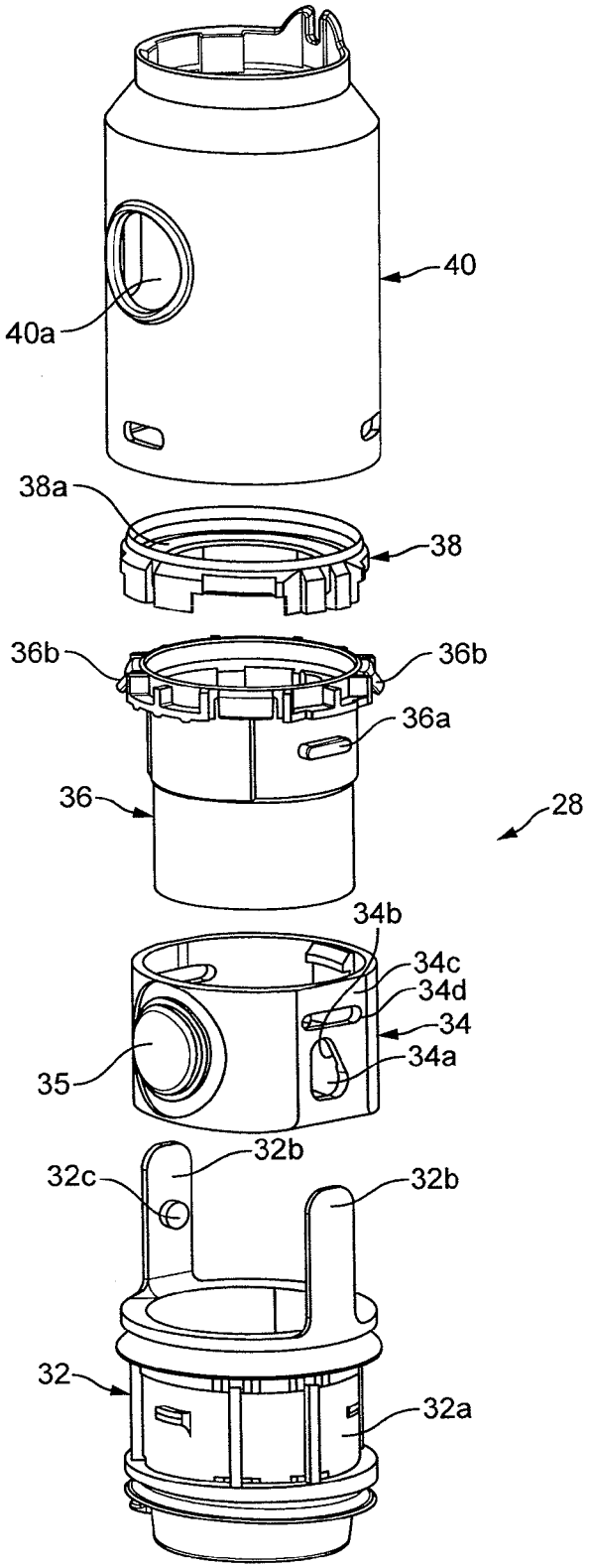
FIG. 7 is an exploded view illustrating the principal components of a hose catch assembly.
Figure 8:
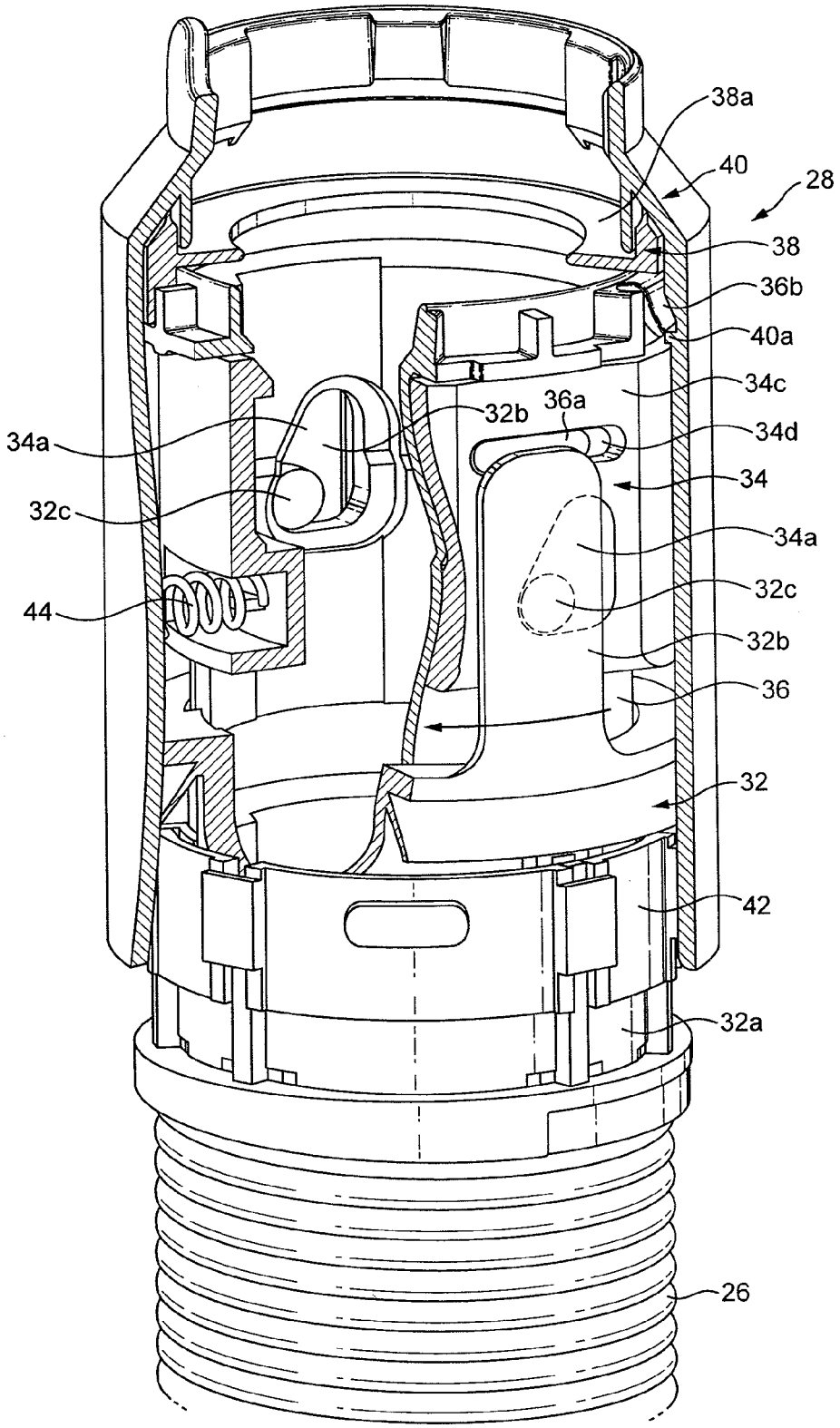
FIG. 8 is a partial cutaway view illustrating the hose catch assembly in FIG. 7, but in its assembled state.

An exploded view of the principal parts of the hose catch assembly 28 is shown in FIG. 7. The final assembly 28 is illustrated in partial cutaway view in FIG. 8; here, the hose 26 has also been included for completeness, but the wand 22 has been omitted to allow a better overall view of the assembly 28. Note also that in FIG. 8 the assembly 28 is shown from the reverse side vis-a-vis FIG. 7.

The assembly 28 comprises a first guide part 32, a hose catch 34, a second guide part 36, a sealing collar 38 and a hose-catch housing 40.

The first guide part 32 is fixed to the end of the hose 26 via a conventional screw-fitting. This first guide part 32 comprises a splined tubular body 32*a* and an opposing pair of arms 32*b* which project from the upper rim of the tubular body 32*a*. These arms 32*b* snap-fit with generally triangular guide windows 34*a* in the sides of the hose catch 34, via respective lugs 32*c* formed on the inside of the arms 32*b* (only one lug 32*c* is visible in FIG. 7). Thus, the arms 32*b* fit around the outside of the hose catch 34, and the hose catch 34 can slide up and down on the arms 32*b*. Each window 34*a* engages the respective lug 32*c* along a ramp surface 34*b*. As the hose catch 34 slides up and down on the arms 32*b*, the lugs 32*c* and the triangular guide windows 34*a* cooperate via these ramp surfaces 34*b* in order to move the hose catch 34 back and forth in the horizontal plane in FIG. 8.

The windows 34*a* are provided in 'flats' 34*c* which prevent relative rotation of the catch 34 and the first guide part 32 as the catch 34 slides up and down.

The second guide part 36 is connected to the hose catch 34 via a pair of elongate locating members 36*a* (only one of which is visible in FIG. 7) which snap-fit into guide channels 34*d* in the hose catch 34. These guide channels 34*d* prevent relative axial movement of the catch 34 and the second guide part 36—so that the second guide part 36 slides up and down with the catch 34 on the arms 32*b*—but allow relative movement of the catch 34 and guide part 36 in the horizontal plane in FIG. 7, so as not to inhibit the aforementioned corresponding movement of the catch 34 back and forth relative to the first guide part 32.

The hose catch housing 40 is fixed to the second guide part 36 for sliding co-movement with this second guide part 36, relative to the first guide part 32. The catch housing 40 fixes to the second guide part 36 via a series of projecting elements 40*a* (one of which is visible in FIG. 8) which snap-fit over the top of a respective series of resilient tabs 36*b* on the second guide part. A collar 42 is additionally snap-fitted to the bottom of the catch housing 40: this collar (omitted from FIG. 7, but visible in the final assembly in FIG. 8) keys to the splined tubular body 32*a* to prevent relative rotation and yawing movement of the catch housing 40 relative to the first guide part 32.

The sealing collar 38 is sandwiched in place between the catch housing 40 and the second guide part 36. This sealing collar 38 comprises an annular rubber sealing member 38*a* which forms a dynamic seal around the lower wand section 22*a*. This is best illustrated in FIG. 9, which corresponds to FIG. 8 but includes the lower wand section 22*a*.

Figure 9:
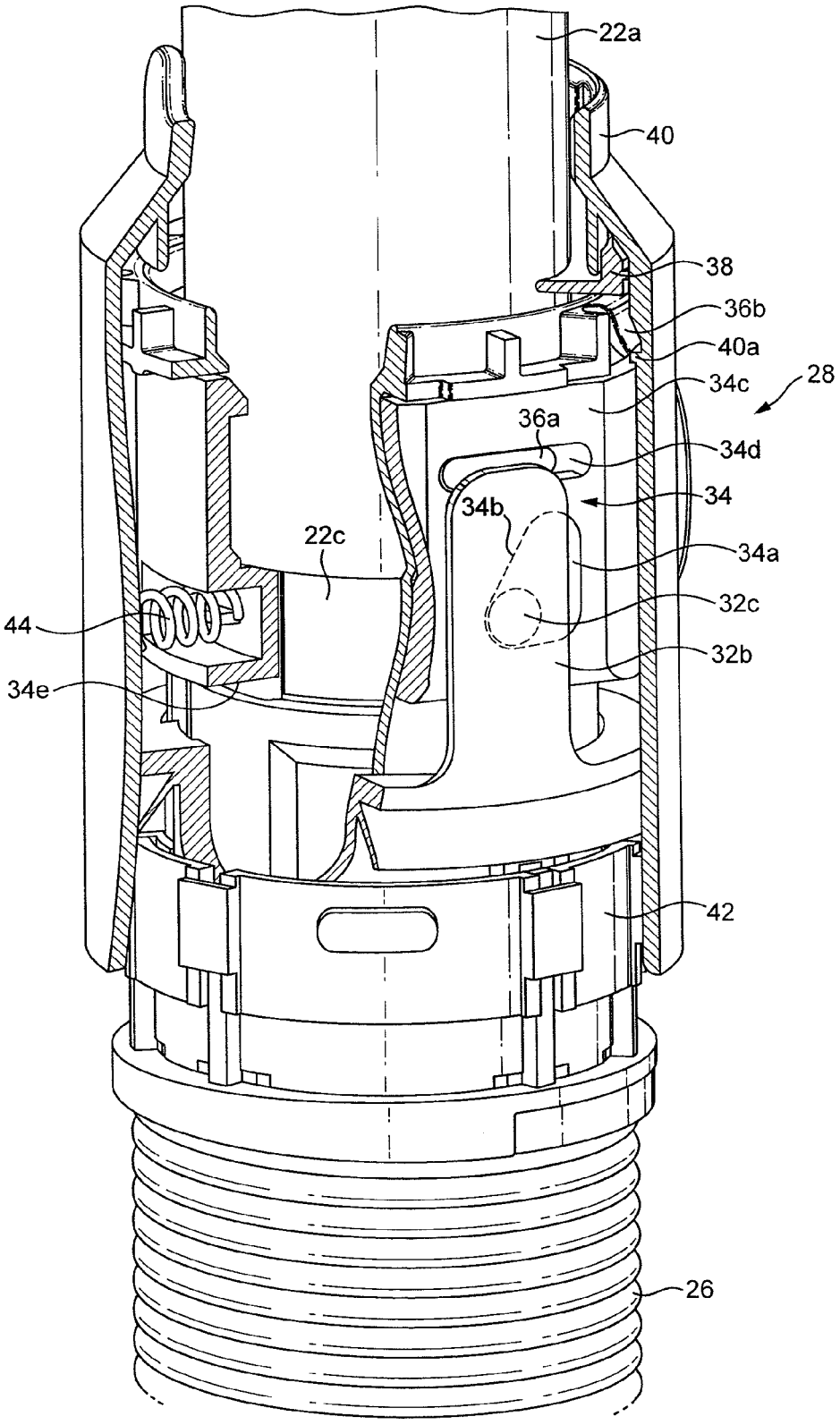
FIG. 9 is another partial cutaway view, corresponding generally to FIG. 8 but with the wand included.

FIG. 9 illustrates the locking position of the hose catch 34. Here, a locking projection 34*e* on the catch 34 is held in engagement with a locking channel 22*c* on the wand 22 by a coil spring 44, which biases the catch 34 to the right in FIG. 9.

Figure 10:
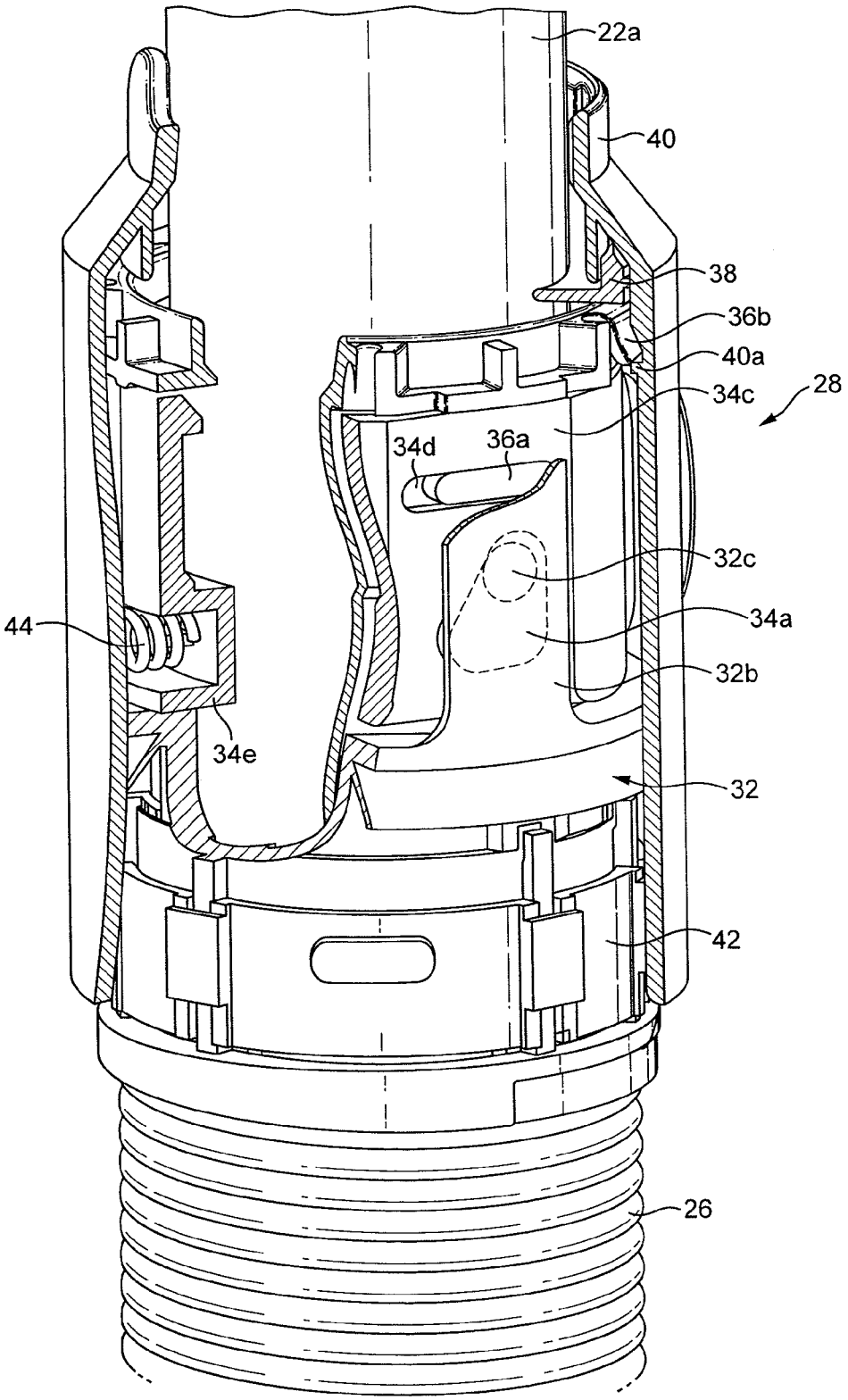
FIG. 10 is a partial cutaway view similar to FIG. 9, but showing the hose catch in a disengaged position.

The hose catch 34 is released by using the hose 26 as a reaction member in its coil-bound state, against which the user may force the catch 34 out of the locking position shown in FIG. 9. This is achieved by applying manual downward pressure on the wand 22. The coil-bound hose 26 is able to react against this downward pressure on the wand, via the first guide part 32—so that the pressure on the wand 22 has the effect of forcing the catch 34 (which is in axial locking engagement with the wand 22 at this point) to slide down the arms 32*b* of the first guide part 32 (which itself is fixed to the coil-bound hose 26). As the hose catch 34 slides down the arms 32*b*, the lugs 32*c* and ramp surfaces 34*b* co-operate in the manner of a wedge to force the hose catch 34 simultaneously to the left in FIG. 9, against the action of the coil spring 44. This movement of the catch 34 in the horizontal plane in FIG. 9 disengages the locking projection 34*e* from the locking channel 22*c* so that the hose catch 34 occupies the release position shown in FIG. 10. At the same instant the wand 22—which is still under downward pressure—'gives way' and slides down into the hose 26, past the locking projection 34*e*.

A manual release element in the form of a push button 35 (FIG. 7) is provided on the hose catch 34. This button 35 is fixed to the hose catch and can be manually depressed to push the entire hose catch 34 into the release position, against the action of the coil spring 44. The button 35 is directly accessible to the user through a window 40*a* in the catch housing 40.

Figure 11:
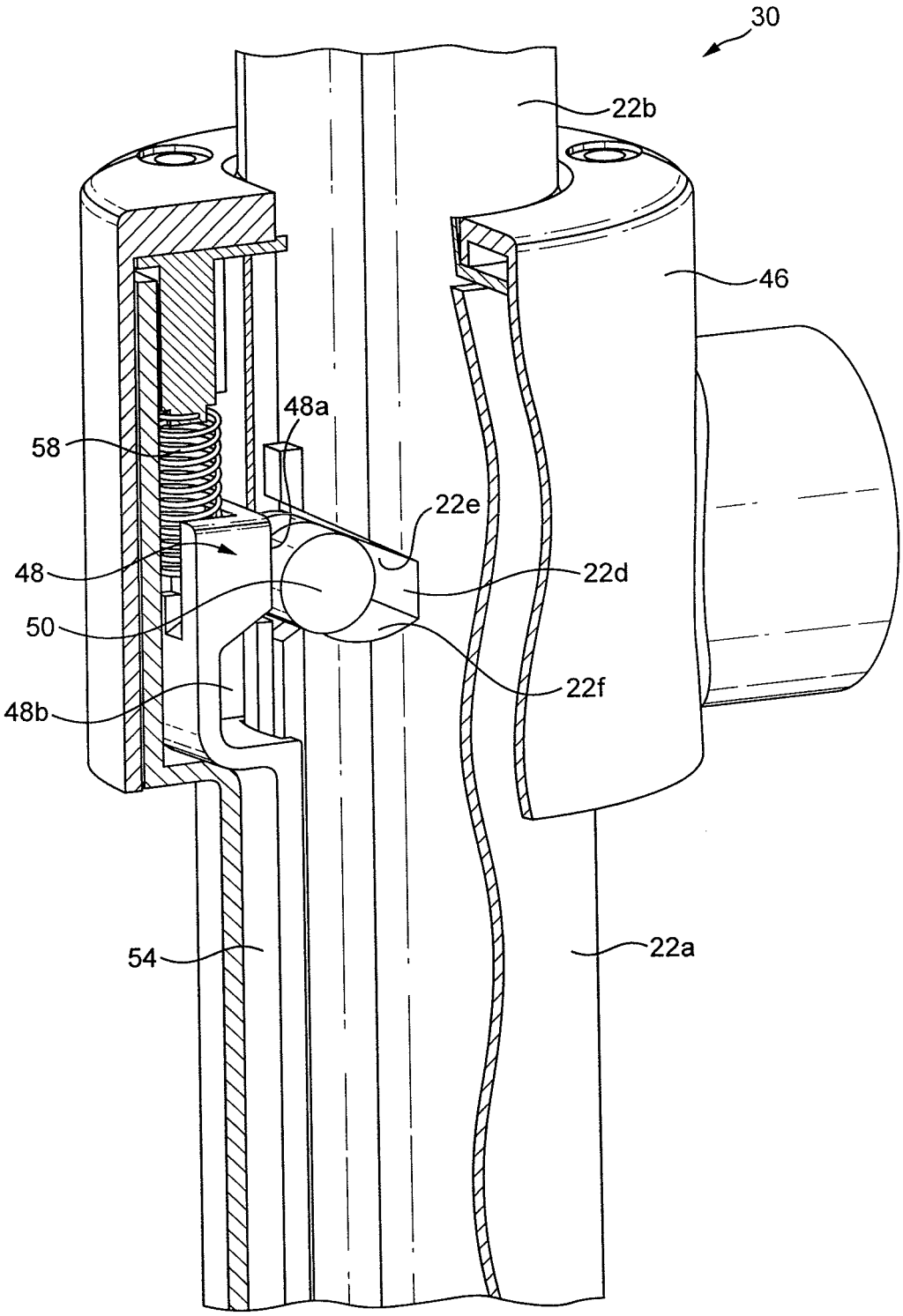
FIG. 11 is a partial cutaway view of a wand catch assembly.

The wand catch assembly 30 is shown in FIG. 11. It is housed inside an annular wand-catch housing 46 provided at the upper end of the lower wand section 22*a* and comprises three co-operative locking elements: a catch recess 22*d* on the upper wand section 22*b*, a locking member 48 mounted on the lower wand section 22*a*, and a floating wand catch 50—in this case a roller catch—which, in the locking position shown in FIG. 11, is engaged with the catch recess 22*d* and held there by the locking member 48 to prevent relative axial movement of the wand sections 22*a*, 22*b*.

The locking action of the wand catch assembly 30 is essentially a wedging action. The locking member 48 is arranged so that it cannot move radially (to the left or right in FIG. 11), and the catch recess 22*d* is tapered to define an upper ramp surface 22*e* and a lower ramp surface 22*f* which respectively co-operate with a locking face 48*a* on the locking member 48 to wedge the wand catch 50 in axial locking engagement with the catch recess 22*d*.

The locking member 48 is mounted on the lower wand section 22*a* so that it can slide up and down. This allows the wand catch 50 to be released by sliding the locking member 48 upwardly to a release position, shown in FIG. 12. In this position, the wand catch 50 is axially aligned with a recess 48*b* in the locking member, which allows the wand catch 50 sufficient space to disengage the catch recess 22*d*—by moving to the left in FIG. 11—under the wedging action of the upper ramp surface 22*e*. Thus, with the locking member 48 in the release position the wand 22*a*, 22*b* may readily be retracted by the user, in the process forcing the wand catch 50 into engagement with the recess 48*b* in the locking member 48 so that the wand catch 50 is free to roll on the outside of the upper wand section 22*b*.

Figure 13:
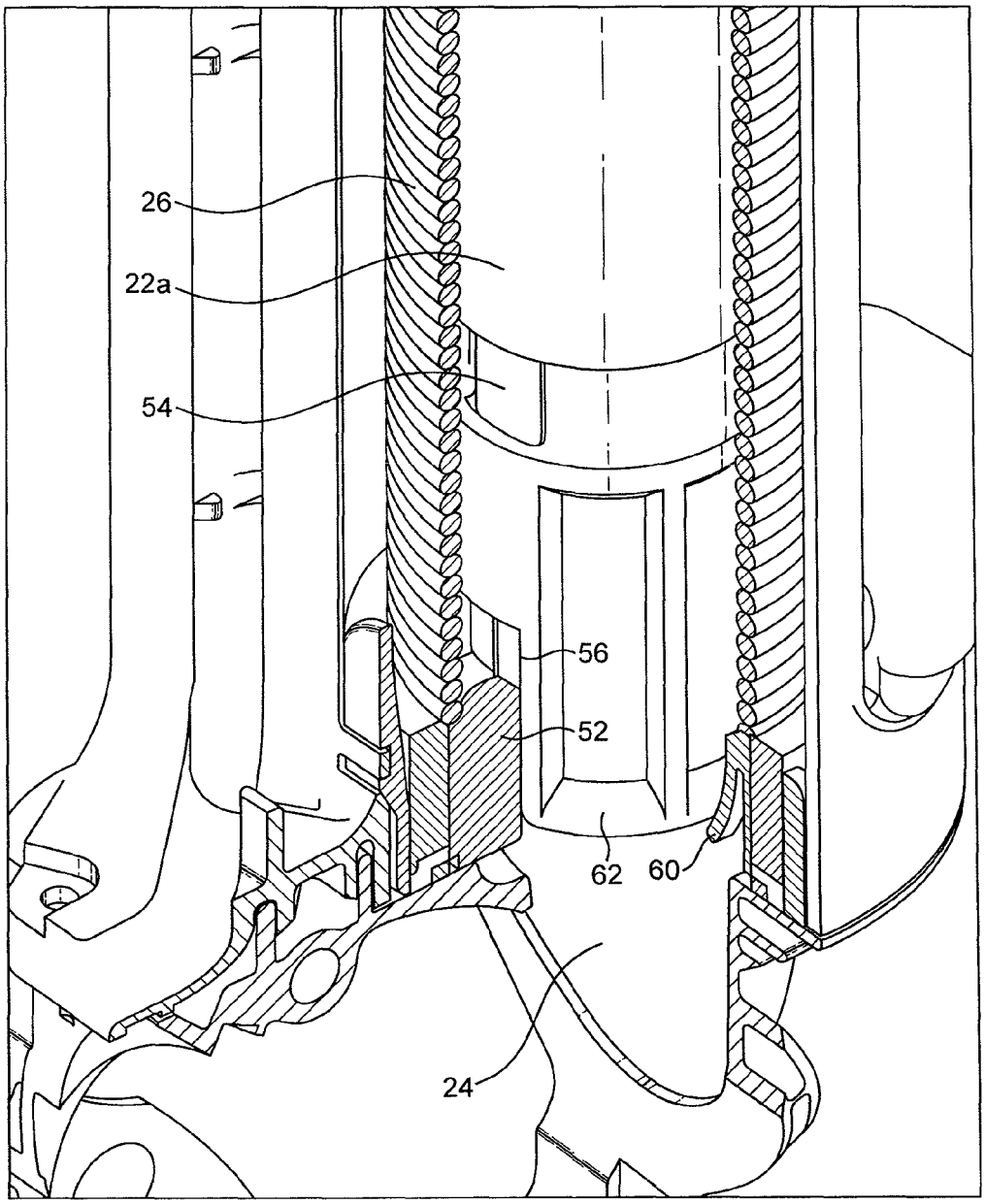
FIG. 13 is a partial cutaway view at the base of the hose, illustrating initial engagement of a push rod with a reaction member as the wand is retracted inside the hose.
Figure 14:
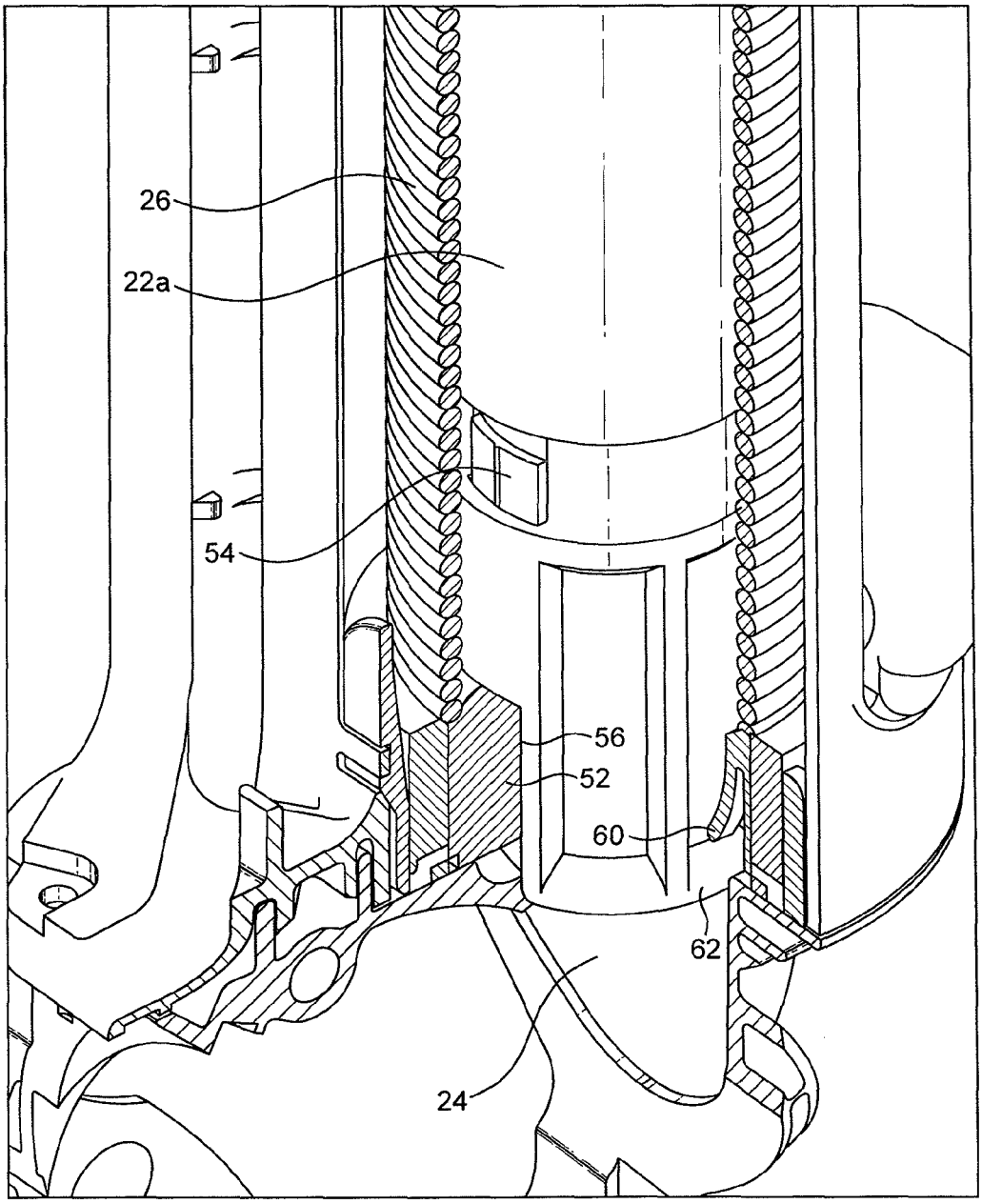
FIG. 14 is a partial cutaway view similar to FIG. 13, but with the wand in a fully retracted position inside the hose.
Figure 15:
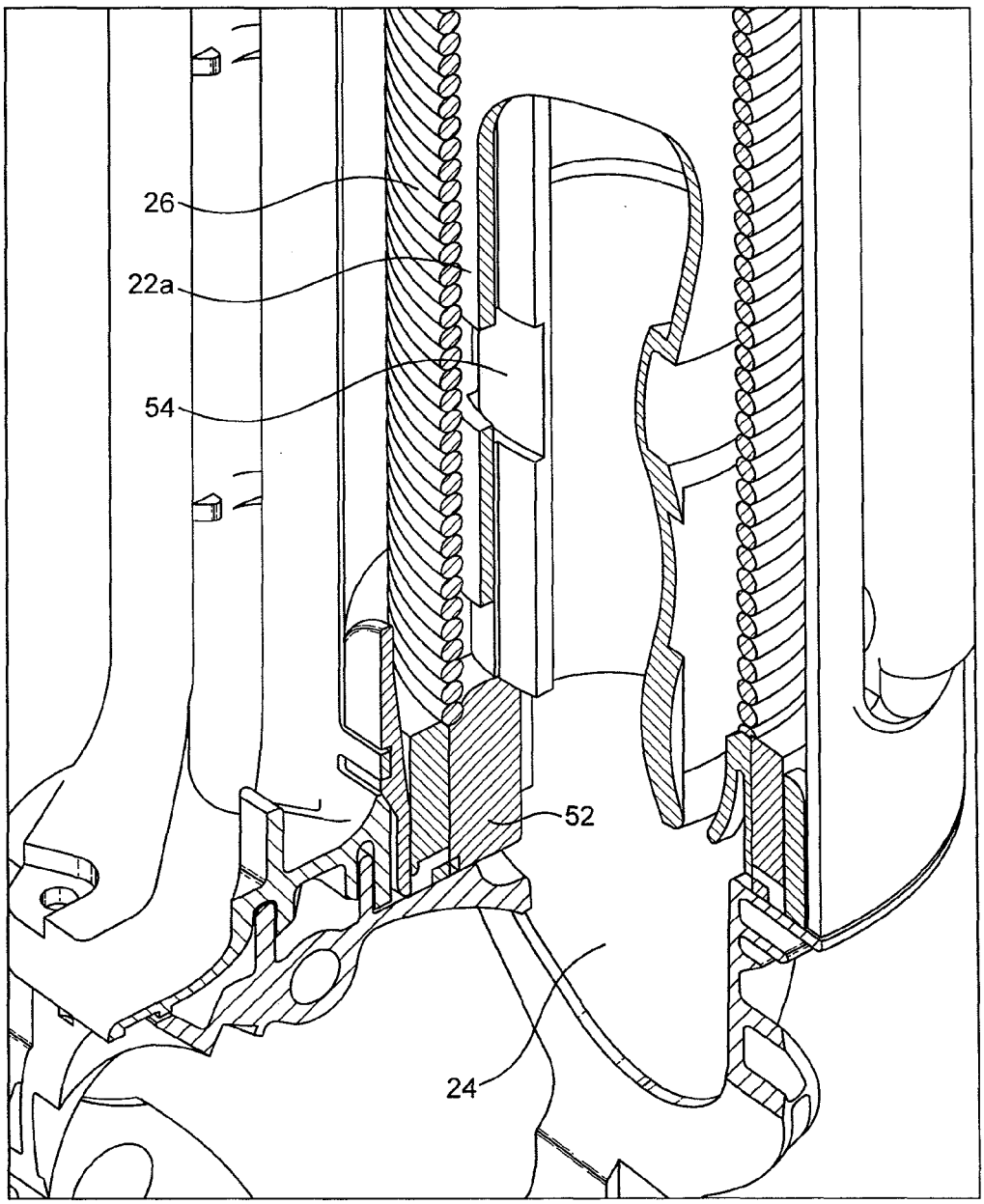
FIG. 15 is a partial cutaway view corresponding to FIG. 14, but with the wand also partially cutaway to show the push rod extending up inside the wand.

The locking member 48 is moved to the release position via a reaction member 52 (FIG. 13) forming part of the inlet duct assembly 24 at the base of the hose 26, against which the locking member 48 may be forced into the release position as the user retracts the wand 22 down inside the hose 26. The locking member 48 engages the reaction member 52 via an elongate push rod 54 which is formed integrally with the locking member 48 (see FIG. 11). This push rod 54 extends axially down the lower wand section 22*a*, terminating near the base of the lower wand section 22*a*. The reaction member 52 arrests downward movement of the push rod 54 as the wand 22 is retracted inside the hose—but not downward movement of the wand 22 itself, which incorporates a cut away section 56 so that it does not engage the reaction member 52—effectively forcing the push rod 54 and locking member 48 upwards relative to the wand 22. This is illustrated in FIGS. 13 and 14, which are cut away views at the base of the hose 26. FIG. 13 shows the push rod 54 initially engaging the reaction member 52 during retraction of the wand 22. FIG. 14 shows the wand 22 in a fully retracted position. FIG. 15 corresponds to FIG. 13 but the wand 22 has also been partially cut away to show the push rod 54 extending inside the lower wand section 22*a*.

Figure 12:
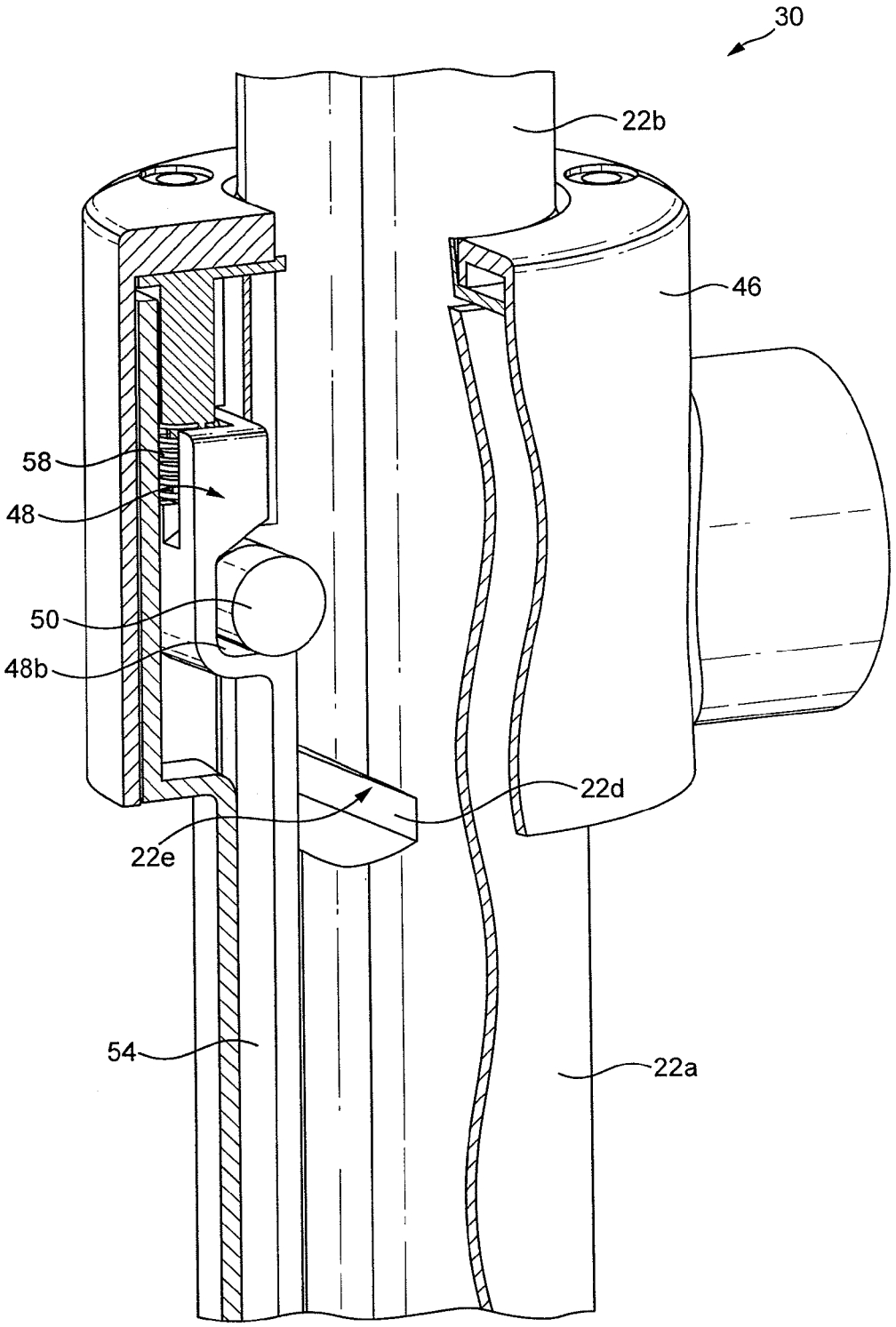
FIG. 12 is a partial cutaway view corresponding to FIG. 11, but with the wand catch released.

The push rod 54 is forced upwards against the action of a coil spring 58 in the catch housing (cf. FIGS. 11 and 12). This spring 58 then loads the locking member 48 in the release position, so that it automatically returns into the locking position when the push rod 54 is subsequently disengaged from the reaction member 52 upon deployment of the wand 22. The coil spring 58 acts between the top of the locking member 48 and the ceiling of the catch housing 46. In order to prevent the loaded coil spring 58 from pushing the whole lower wand section 22*a* upwards when the locking member 48 is in the release position, sprung tabs 60 are provided on the inside of the inlet duct 24 (FIG. 14) which engage with a flared rim 62 of the lower wand section 22*a* when it is fully retracted, in order to hold the lower wand section 22*a* down in the fully retracted position.

The configuration of the hose catch assembly 28 and the wand catch assembly 30 is such that neither the locking member 48 nor the hose catch 34 are directly accessible to the user in normal use. This helps prevent accidental retraction of the wand sections 22*a*, 22*b* and/or accidental retraction of the wand 22 into the hose 26. When it is desired to store the wand 22 and hose 26 after use, the user simply retracts the hose 26 until it is coil-bound, and applies downward pressure to the wand 22 against the coil-bound hose 26 automatically to release the internal hose catch 34, as described. Once the hose catch 34 has released, the user can then retract the wand 22 inside the coil-bound hose 26. This retraction of the wand 22 inside the hose 26 in turn automatically releases the internal wand catch 50, via the push rod 54 and locking member 48, as described, so that the upper wand section 22*b* can then be retracted inside the lower wand section 22*a*.

The retracted wand 22 is stored along a channel 64 which runs down the rear of the handle assembly 20—parallel to the slide axis of the handle assembly 20—and which continues full length down the back of the cleaner 10 (see FIG. 4).

To hold the stored wand 22 securely in place on the cleaner 10, the wand 22 is additionally arranged to connect at its upper end to the handle assembly 20. The connecting arrangement—illustrated in FIG. 16—comprises a pair of longitudinal ribs 66 on the upper wand section 22*b* (only one rib 66 is visible in FIG. 16), which engage with respective longitudinal channels 68 on the handle assembly 20 in a sliding friction-fit. This straightforward sort of arrangement for connecting the wand 22 to the handle assembly 20 in effect allows the retracted wand 22 simply to be hooked onto the back of the handle assembly 20 following release of the wand catch 50, and likewise to be unhooked when it is required to deploy the wand 22.

By connecting the upper wand section 22*b* to the sliding handle assembly 20 and the lower wand section 22*a* to the inlet duct assembly 24—via the sprung tabs 60—the stored wand 22 is able to extend and retract freely in unison with extension and retraction of the sliding handle assembly 20.

Figure 16:
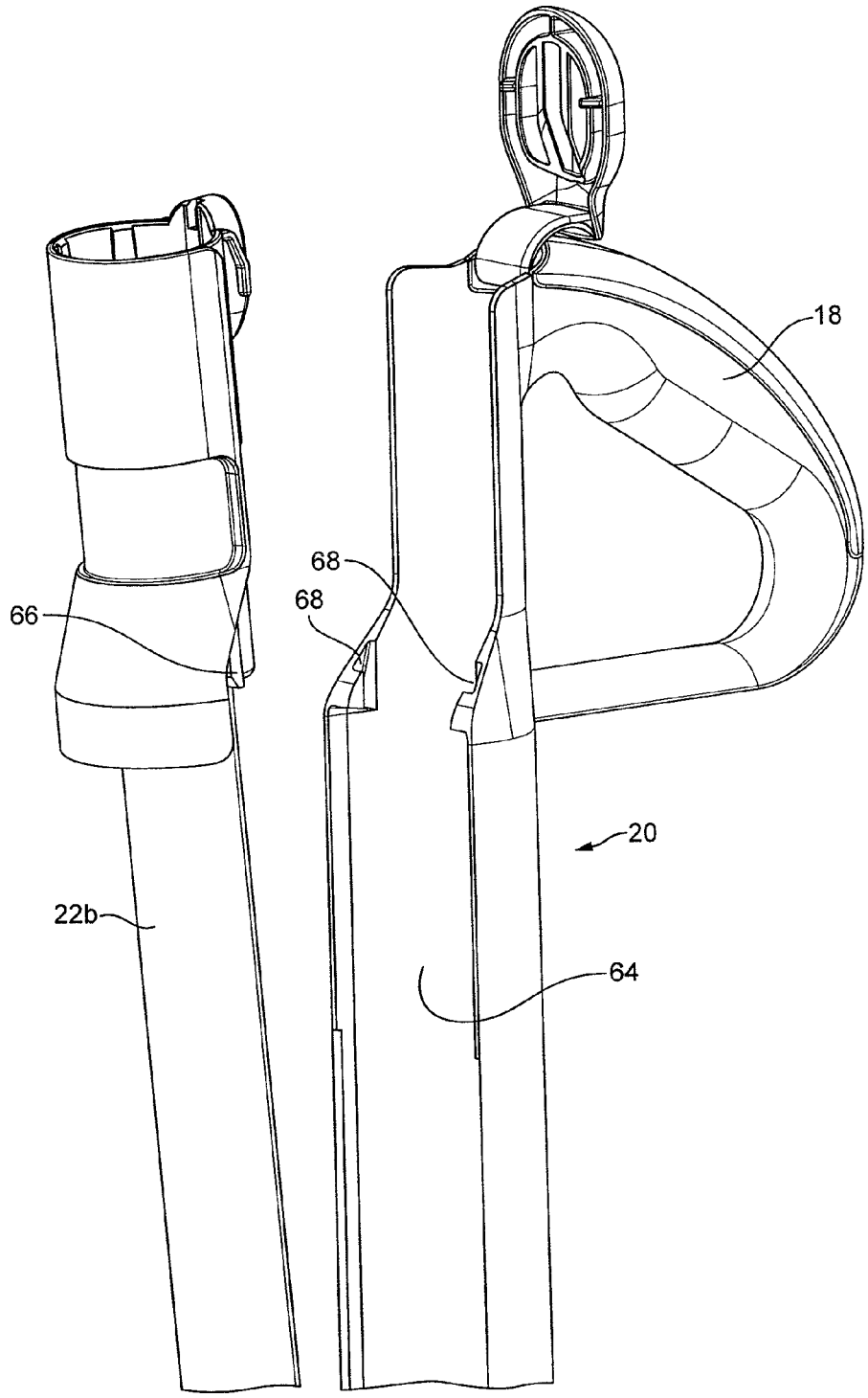
FIG. 16 is a rear perspective view of the wand and the handle assembly on the vacuum cleaner in FIG. 3.

A simple friction-fit hooking arrangement for connecting the upper wand section 22*b* to the handle assembly 20—such as the one shown in FIG. 16—is easy to use, but it has the practical disadvantage that the friction-fit between the longitudinal ribs 66 and channels 68 may be insufficient in certain circumstances to maintain connection between the wand 22 and the handle assembly 20 as the handle assembly 20 is manually retracted.

Figure 17:
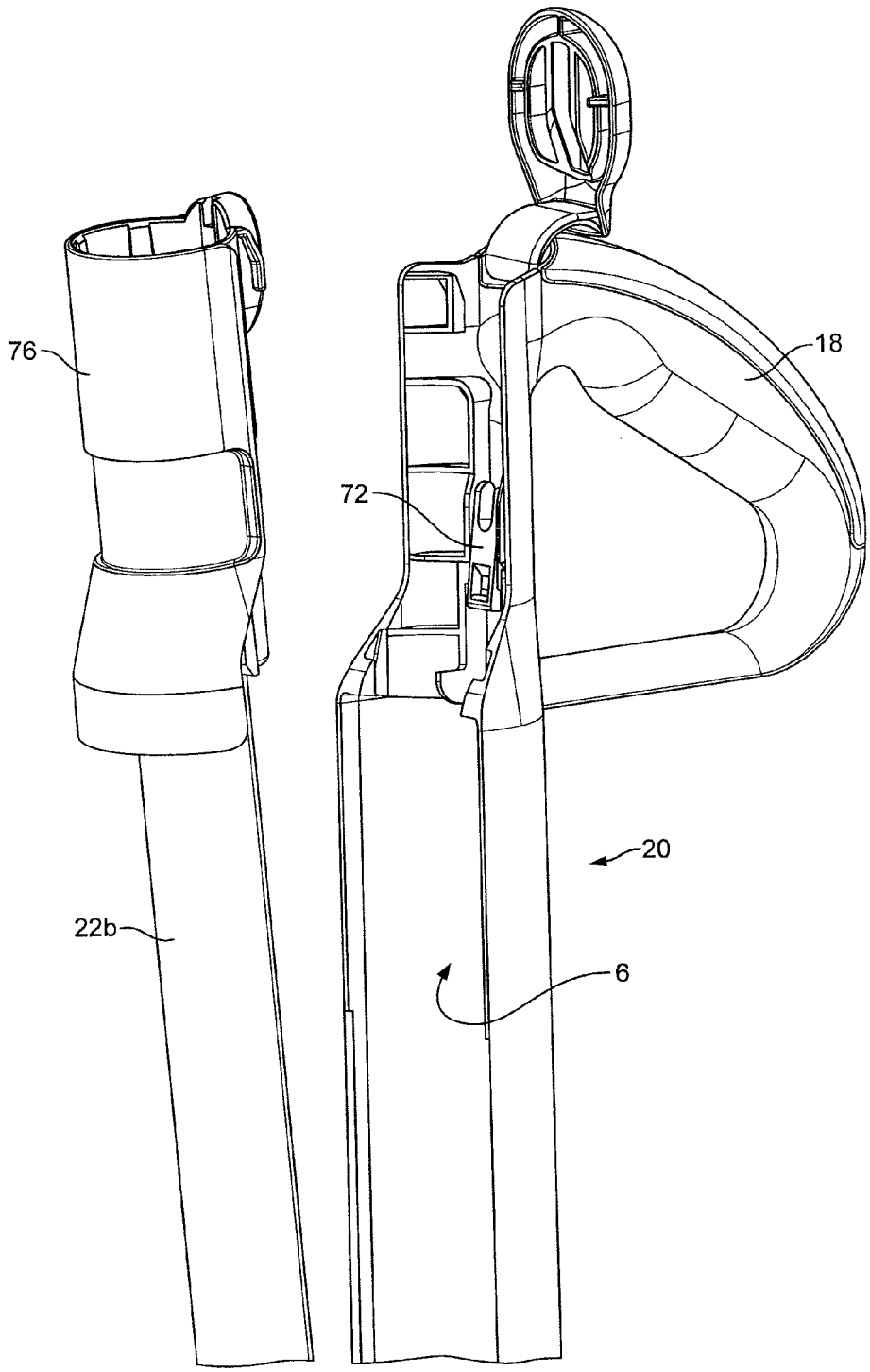
FIG. 17 is a rear perspective view illustrating a secondary interlock mechanism for engaging the wand with the handle assembly.
Figure 18:
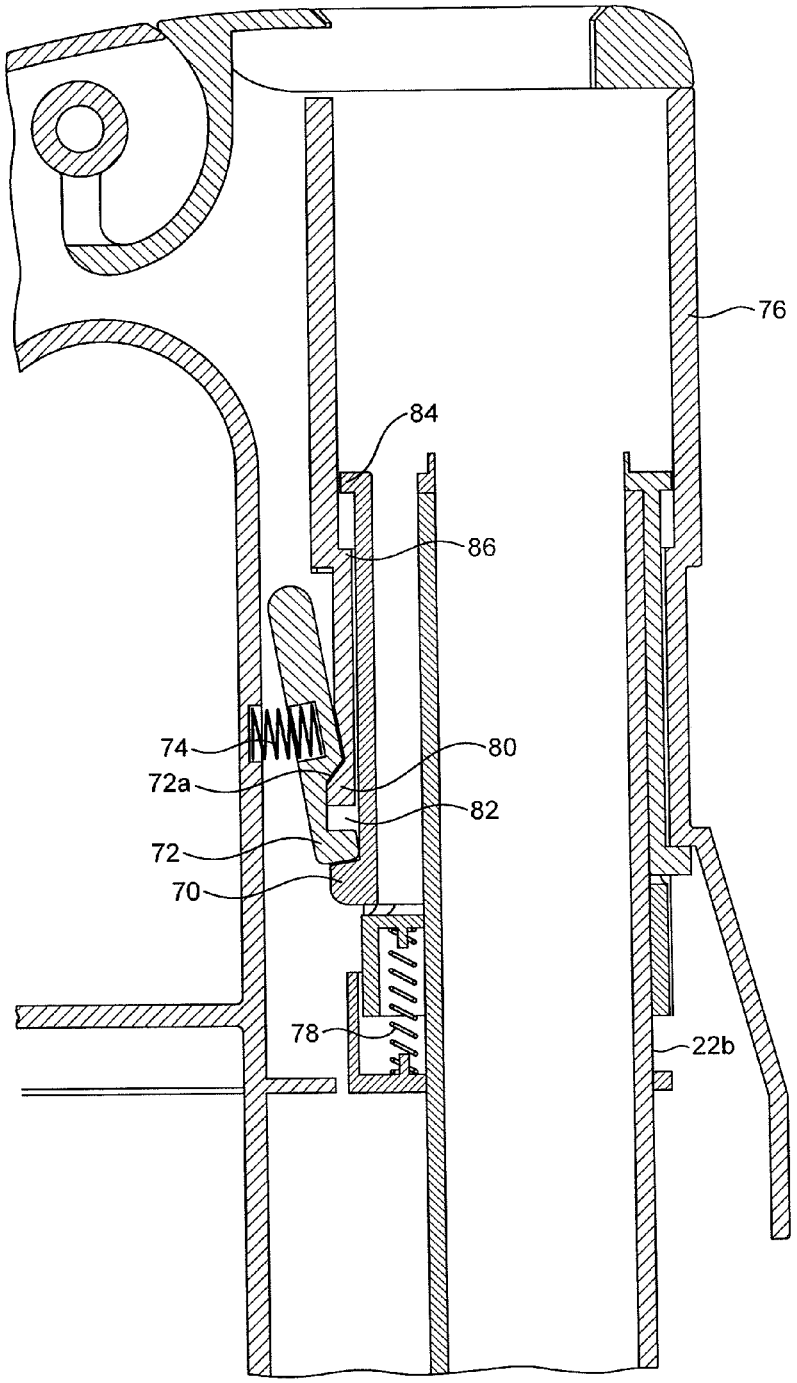
FIG. 18 is a side sectional view of the secondary interlock mechanism shown in FIG. 17.
Figure 19:
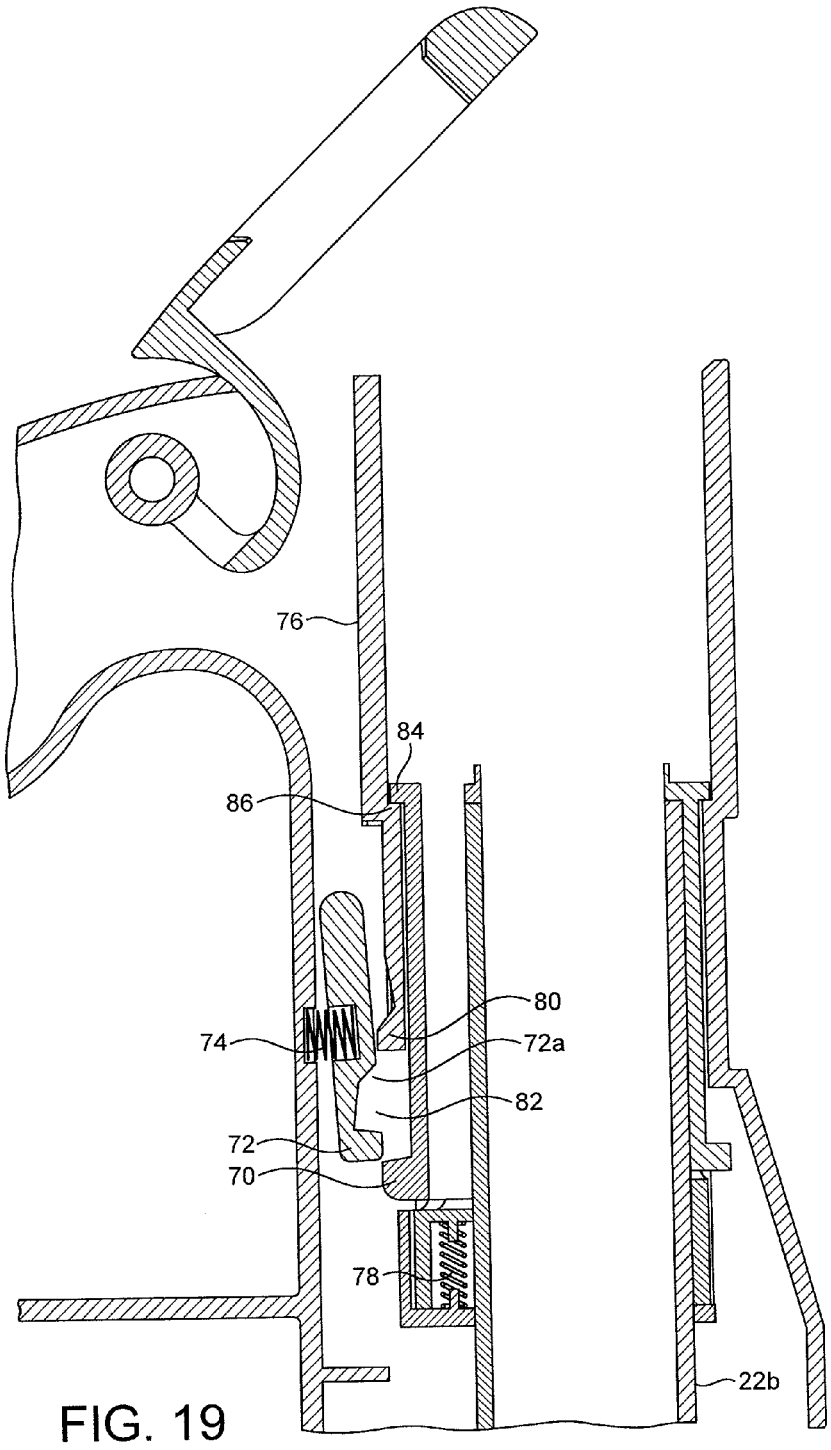
FIG. 19 is a side sectional view of the arrangement shown in FIG. 17, taken from the same side as FIG. 18 but with the secondary interlock mechanism in a release position.
Figure 20:
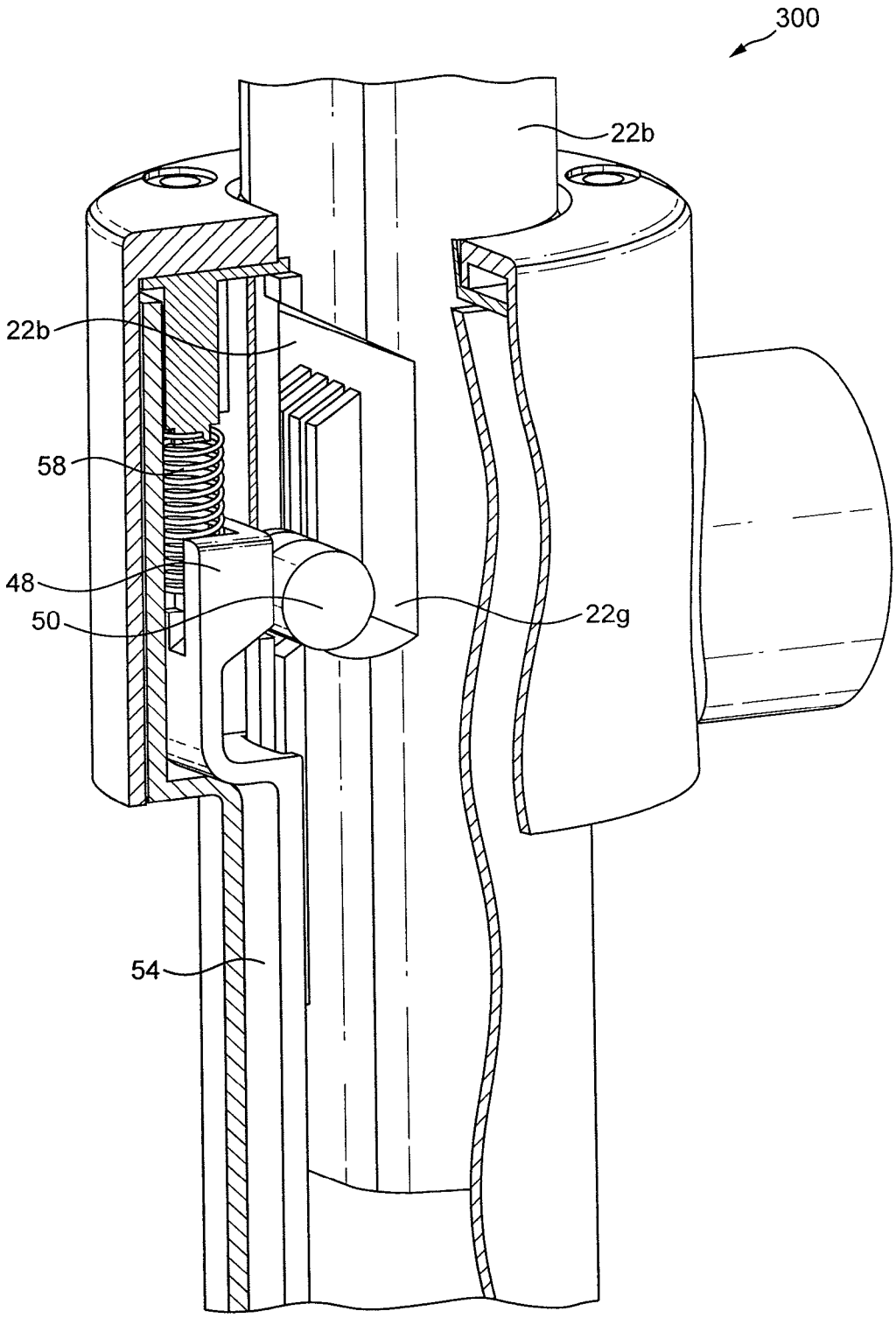
FIG. 20 is a cutaway perspective view of an alternative wand catch assembly incorporating a dual catch arrangement, in this case showing the wand catch engaged with a lower catch recess on the wand to lock out the wand sections in an extended configuration.
Figure 21:
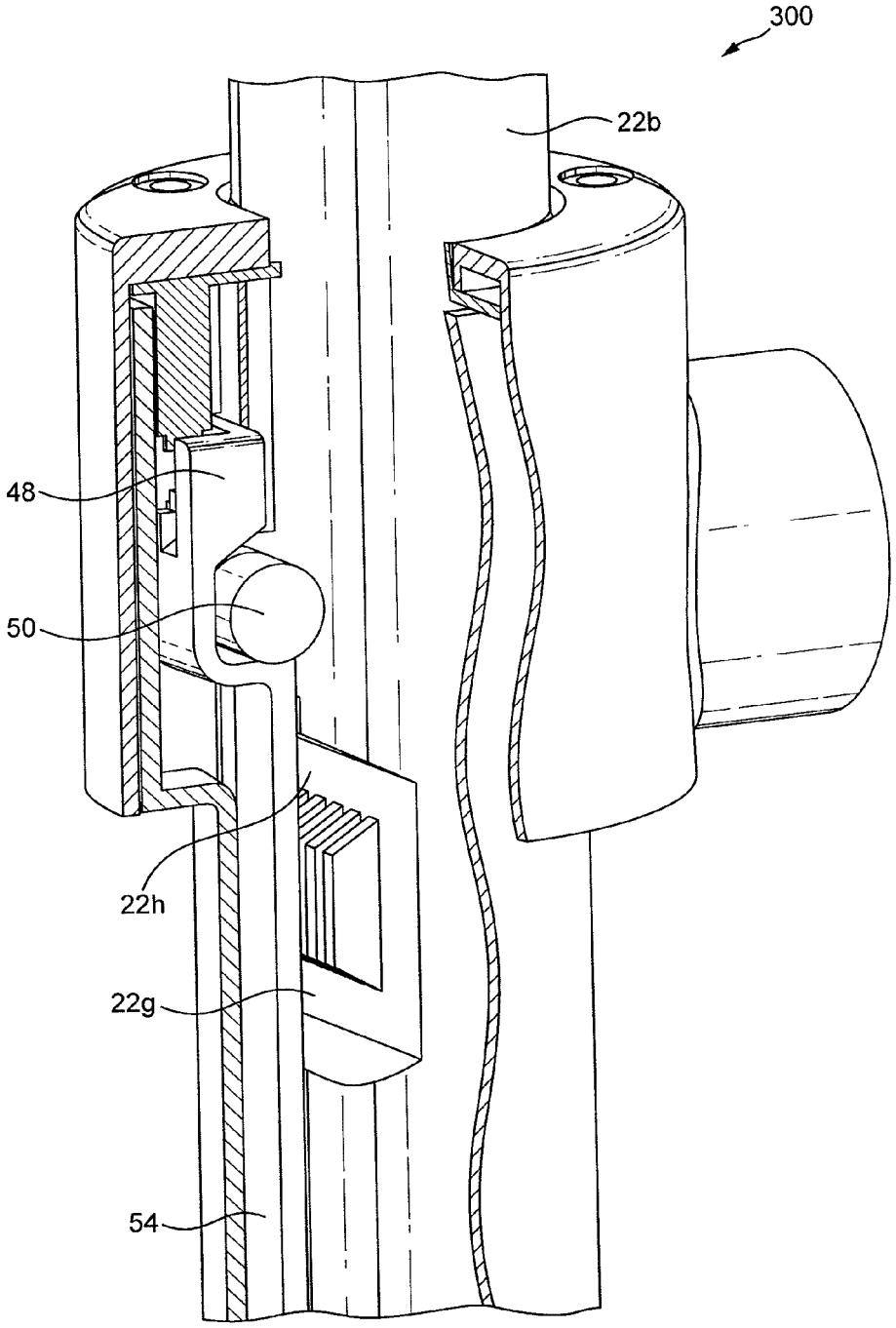
FIG. 21 is a cutaway perspective view similar to FIG. 20, but showing the wand catch in a release position, allowing telescopic retraction of the wand.

FIGS. 17 to 19 show an alternative connecting arrangement for the upper wand section 22*b* and the handle assembly 20 which addresses this drawback associated with the simple friction-fit arrangement in FIG. 16. This alternative connecting arrangement uses the same longitudinal ribs 66 and channels 68 as the arrangement in FIG. 16—which slidably engage in a friction-fit as before—but additionally incorporates a secondary interlock mechanism for securely locking the upper wand section 22*b* to the handle assembly 20.

The secondary interlock mechanism comprises a catch feature in the form of a locking tooth 70 on the upper wand section 22*a* which—guided by the longitudinal ribs 66 and channels 68—is arranged to ride down over a pivotable catch member 72 on the handle assembly 20. This catch member 72 is spring-loaded by a catch spring 74 so that, once the locking tooth 70 clears the catch member 72, the catch member 72 then snaps into the locking position shown in FIG. 18. In this position, the catch member 72 co-operates with the locking tooth to prevent subsequent movement of the wand section 22*b* upwards relative to the handle assembly 20, effectively locking the wand 22 securely to the handle assembly 20. This ensures that as the handle assembly 20 is subsequently retracted to the compact storage configuration shown in FIG. 4, the upper wand section 22*b* likewise retracts inside the lower wand section 22*a*: there is no tendency for the wand 22 and the handle assembly 20 to get out of sync.

The catch member 72 is released via a manual release member 76. This release member 76 is in the form of a generally cylindrical sleeve which is slidably mounted on the upper end of the wand section 22*b*. The release member 76 is downwardly biased towards the position shown in FIG. 18 by a separate coil spring 78, which acts between the release member 76 and the upper wand section 22*b*. The release member 76 carries an unlocking tooth 80 at its lower end. In the position shown in FIG. 18, this unlocking tooth 80 is engaged with a recess 82 in the catch member 72.

To release the stored wand 22, a user pulls up on the sleeve 76, which slides the sleeve 76 upwardly against the action of the coil spring 78, relative to the catch member 72 (the upper wand section 22*b* itself is prevented from moving upwards at this point by the mechanical interlock between the catch member 72 and the locking tooth 70). As the sleeve moves upwards, the unlocking tooth 80 co-operates with a ramped surface 72*a* on the catch member 72 to force the catch member 72 out of its locking position against the action of the catch spring 74 and into a release position shown in FIG. 19. With the catch member 72 in this release position, the locking tooth 70 is free to slide upwardly past the catch member 72.

A stop 84 on the upper wand section 22*b* is arranged to engage with a respective shoulder 86 on the sleeve 76 in order to prevent the sleeve 76 from sliding off the upper wand section 22*b*—so that instead the sleeve 76 tops out on the stop 84. This stop 84 is arranged so that—during release of the stored wand 22—it engages the shoulder 86 only after the catch 72 has been moved to the release position. This then allows the user to pull the entire upper wand section 22*b* upwards—past the catch member 72—in one continuous motion, simply by continuing to pull on the sleeve 76. Thus, the straightforward hooking action to engage and release the wand 22 from the handle assembly 20—characteristic of the simple friction-fit arrangement in FIG. 16—is essentially maintained regardless of the secondary interlock mechanism.

Once the upper wand section 22*b* has been released from the handle assembly 20, the user wishing to deploy the wand 22 just continues to pull upwards on the upper wand section 22*b* (pulling either directly on the upper wand section 22*b* or, where the secondary interlock mechanism is provided, pulling via the sleeve 76 as appropriate). This has the effect of extending the wand 22, with any sliding friction between the wand sections 22*a*, 22*b* being overcome by the sprung tabs 60, which continue to hold the lower wand section 22*a* in place.

When the upper wand section 22*b* reaches its fully extended position, the catch recess 22*d* is aligned with the wand catch 50 and at this point the upper wand section 22*b* tops out on a stop (not visible) provided on the lower wand section 22*a*. This means that as the user continues to pull on the upper wand section 22*b*, the entire wand 22 starts to withdraw from the hose 26, disengaging the push rod 54 from the reaction member 52 so that the locking member 48 returns to its locking position under the action of the coil spring 58. As the locking member 48 returns to its locking position, a ramped surface 48*c* on the locking member 48 helps ensure that the wand catch 50 is forced laterally into engagement with the catch recess 22*d*, at which point the wand sections 22*a*, 22*b* are locked in the extended position until such time as the push rod 54 is re-engaged with the reaction member 52.

To lock the hose catch 34, the user simply continues to extend the wand 22 until the locking channel 22*c* on the lower wand section 22*a* aligns with the locking projection 34*e* on the hose catch 34, at which instant the locking projection 34*e* snaps into engagement with the locking channel 22*c* under the action of the coil spring 44. The wand 22 is now fully locked out and in an extended position, ready for use.

The wand sections 22*a*, 22*b* are keyed to one another so that they cannot undergo relative rotation about their longitudinal axis. This allows the wand 22 to be used as a torsional brace for the relatively weak handle assembly 20 when the wand 22 is engaged with the handle assembly 20. The handle assembly 20 is braced via a pair of flats on the lower wand section 22*a* which slidably engage with a respective pair of flats positioned internally at the base of the hose 26, effectively to key the lower wand section 22*a* to the inlet duct assembly 24.

In certain circumstances the sprung tabs 60 may be inadequate to hold the lower wand section 22*a* in its fully retracted position shown in FIG. 12. One particular case where this may be so, is if the lower wand section 22*a* is forced directly upwards by the user accidentally knocking up against the wand catch housing 46 on the lower wand section 22*a*. This is unlikely to be a problem if the handle assembly 20 is in the retracted position (FIG. 4)—because the wand catch housing 46 will quickly top out on the cylindrical sleeve 76, so that the weight of the handle assembly 20 and upper wand section 22*b* then effectively acts against the lower wand section 22*a*—but it may be a problem if the handle assembly 20 is in the extended position (FIG. 3), because then the sprung tabs 60 are the only means acting to restrain upward movement of the lower wand section 22*a*. It may be preferable therefore to provide an arrangement for limiting independent upward movement of the lower wand section 22*a* when the handle assembly 20 is extended, particularly if the lower wand section 22*a* is being relied upon to brace the handle assembly 20 in the storage position.

FIGS. 20 to 23 show an alternative type of wand catch assembly 300 which co-operates with the secondary locking mechanism described above to limit accidental movement of the lower wand section 22*a* when the wand 22 is stored on the cleaner 10. The wand catch assembly 300 is similar to the wand catch assembly 30, the main difference being that the wand catch assembly 300 incorporates a double catch arrangement comprising two axially-spaced catch recesses 22*g* and 22*h* on the upper wand section 22*b*. Common reference numerals have been used for common features, where appropriate.

The lower catch recess 22*g* functions in essentially the same way as the single locking channel 22*c* in the arrangement of FIG. 11: the upper wand section 22*b* is arranged to top out on a stop on the lower wand section 22*a* such that when the upper wand section 22*b* is in the fully extended position, the wand catch 50 aligns specifically with this lower catch recess 22*g*. Thus, if the user continues to pull up on the fully extended wand 22 to deploy the wand 22, the push rod 54 disengages from the reaction member 52 at the bottom of the wand and the locking member 48 then forces the wand catch 50 into engagement with the lower catch recess 22*g*—under the action of the coil spring 58—in order to lock the two wand sections 22*a*, 22*b* together for use. The wand catch 50 is likewise released from the lower catch recess 22*g* by forcing the push rod 54 back against the reaction member 52 using wand, thus moving the locking member 48 into the release position shown in FIG. 21. The upper wand section 22*b* may then be retracted into the lower wand section 22*a*—and engaged with the handle assembly 20—for storage. Throughout this sequence, the wand catch 50 never engages with the upper catch recess 22*h*, which like the lower catch recess 22*g* is free to slide past the wand catch 50 once the locking member is in the release position, so that it does not inhibit retraction of the upper wand section 22*b* into the lower wand section 22*a* (as the handle assembly 20 is retracted, for example).

Figure 22:
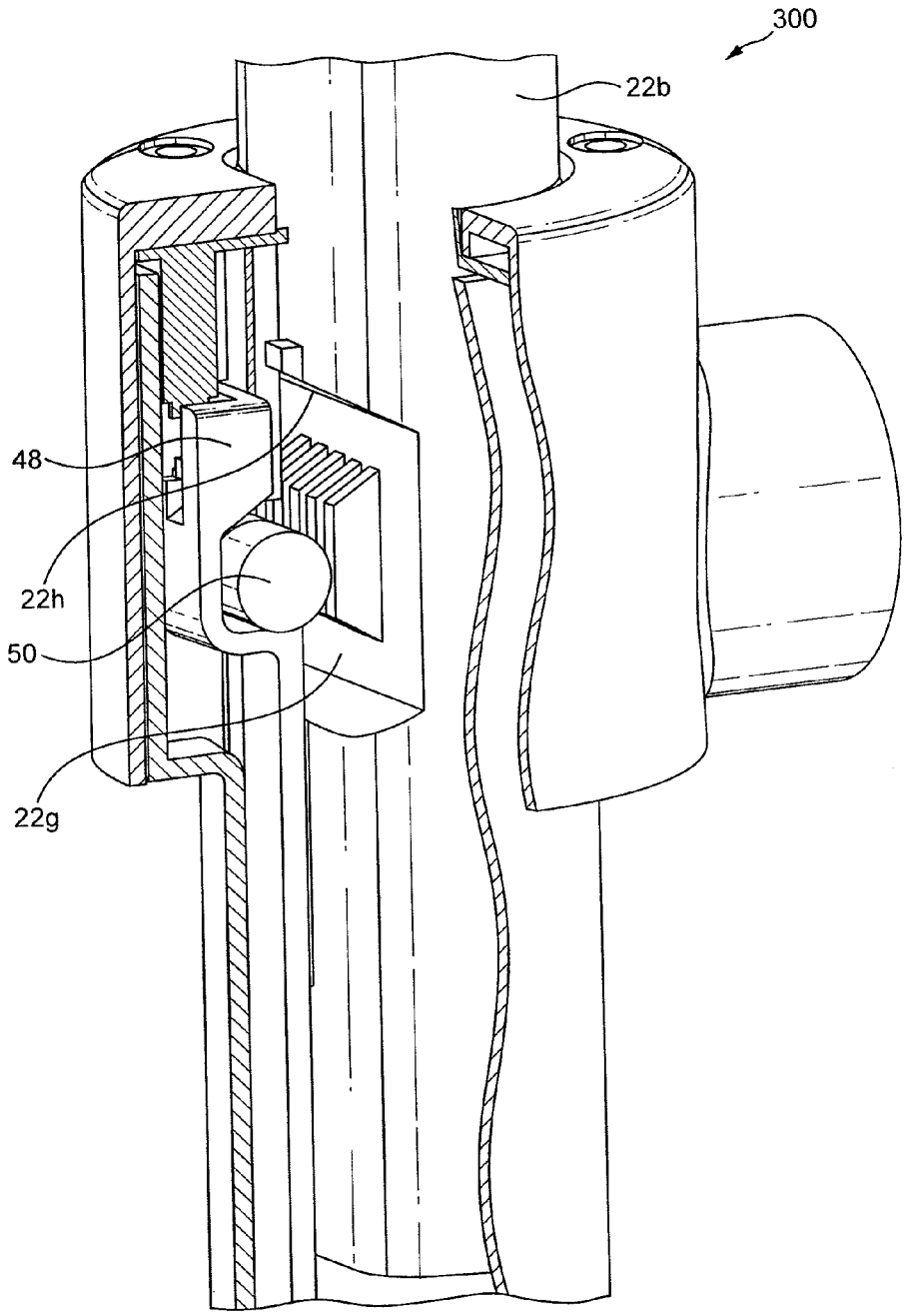
FIG. 22 is a cutaway perspective view of the alternative wand catch assembly illustrating the relative position of the wand catch and upper catch recess when the handle assembly is in the extended position on the cleaner.
Figure 23:
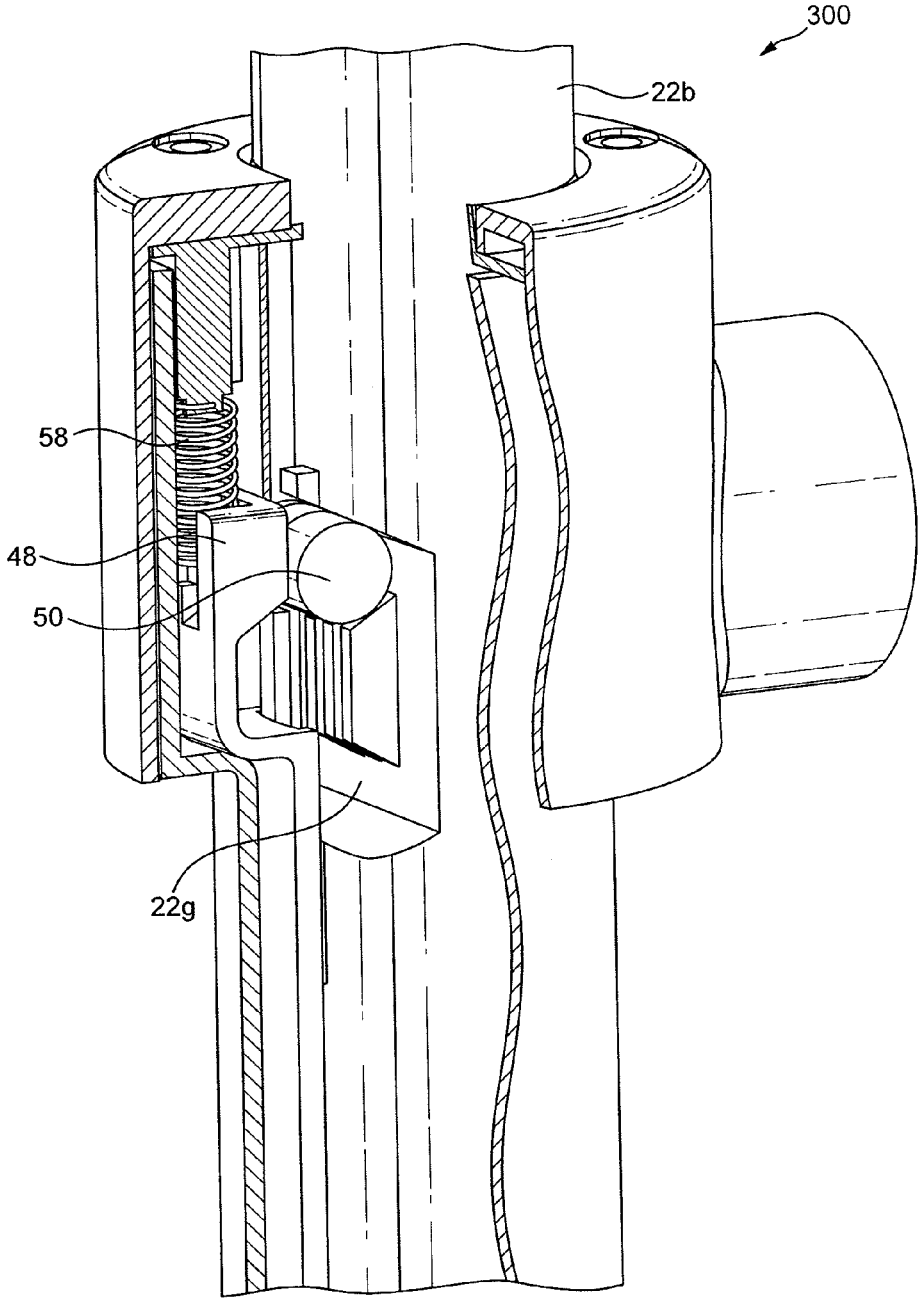
FIG. 23 is a cutaway perspective view similar to FIG. 22, but illustrating engagement of the wand catch with the upper catch recess to arrest independent upward movement of the lower wand section.

When the handle assembly 20 is in the extended position (FIG. 3), the wand catch 50 sits in-between the two catch recesses 22*g*, 22*h* (FIG. 22). In this position, the upper catch recess 22*h* functions as a secondary lock for the lower wand section 22*a*. Thus, if the user accidentally knocks the lower wand section 22*a* upwards—with sufficient force to disengage the sprung tabs 60 (FIG. 14)—the push rod 54 will disengage the reaction member 52 at the bottom of the wand, and the locking member 48 then forces the wand catch 50 into engagement with the upper catch recess 22*h*, under the action of the coil spring 58. This arrests upward movement of the lower wand section 22*a*. It will be appreciated that the relative positioning of the wand catch 50 and upper catch recess 22*h* is important for ensuring effective operation of the secondary locking function: the wand catch 50 must engage the upper catch recess 22*h* before the flats on the lower wand section 22*a* disengage the flats on the inlet duct assembly 24 in order to maintain the bracing function of the wand 22.

Following engagement of the wand catch 50 in the upper catch recess 22*h*, the wand 22 can nevertheless be released for use in the same manner as before, simply by pulling up on the upper wand section 22*b* (either directly or, in the arrangement of FIG. 17, via the sleeve 76). The wand catch 50 remains engaged with the upper catch recess 22*h* until the wand 22 is returned for storage, at which point the push rod 54 is forced against the reaction member 52 to move the locking member 48 to the release position and the wand 22 can then be retracted to the default storage position shown in FIG. 5.

The extended length of the wand 22 is slightly shorter if the wand catch 50 is engaged in the upper catch recess 22*h*, rather than the lower catch recess 22*g*, but the axial separation of the catch recesses 22*g*, 22*h* can be designed to limit this difference so that it is imperceptible to the user, whilst still maintaining the secondary locking function described above.

The invention claimed is:

1. An upright vacuum cleaner comprising a telescopic suction wand fluidly connected to a separating apparatus on the cleaner via a hose and which can be used to clean above the level of the floor, the wand comprising a lower wand section, an upper wand section telescopically mounted to the lower wand section and a moveable locking member which, when the wand is released for use, is biased by a biaser towards a locking position for locking out the wand sections in telescopic extension, the locking member being releasable from this locking position via engagement between an engagement member and a reaction member provided on the cleaner, against which reaction member a user can readily force the biased locking member out of the locking position using the wand with the wand sections locked out in telescopic extension.

2. The upright vacuum cleaner of claim 1, wherein the wand retracts inside the hose for compact storage onboard the cleaner and wherein the reaction member forms part of an inlet duct assembly fluidly connecting the base of the hose to the separating apparatus, the locking member being arranged to force against the reaction member during normal retraction of the lower wand section inside the hose.

3. The upright vacuum cleaner of claim 2 wherein the locking member is provided on the lower wand section and cooperates with a first locking feature on the upper wand section to lock out the wand sections in telescopic extension.

4. The upright vacuum cleaner of claim 3, wherein the locking feature is a catch recess, and the locking member co-operates with the first locking feature via an intermediate catch.

5. The upright vacuum cleaner of claim 3, wherein the locking member is a sliding locking member which is mounted on the lower wand section for sliding movement between said locking position and a release position.

6. The upright vacuum cleaner of claim 5, wherein the engagement member comprises an elongate, axially-sliding push rod mounted on the lower wand section.

7. The upright vacuum cleaner of claim 6, wherein the locking member is formed integrally with the push rod.

8. The upright vacuum cleaner of claim 1, wherein the locking member is hidden away from the user inside a wand catch-housing.

9. The upright vacuum cleaner of claim 6 or 7, in which the push rod is hidden away from the user in between the two wand sections.

10. The upright vacuum cleaner of claim 9, in which the lower wand section is generally cylindrical and the upper wand section has a generally D-shaped cross section to define an axial channel between the two wand sections, the push rod extending down inside this channel.

11. The upright vacuum cleaner of claim 5, wherein the upright vacuum cleaner comprises a handle and the wand sections are keyed to one another so that the wand acts as a torsion brace between the handle and the inlet duct assembly.

12. The upright vacuum cleaner of claim 11, wherein the lower wand section and the inlet duct assembly are arranged for axial sliding engagement to key the lower wand section to the inlet duct assembly.

13. The upright vacuum cleaner of claim 12, wherein the wand comprises a second locking feature for co-operating with the locking member, the second locking feature being positioned on the upper wand section above the first locking feature such that when the handle is in the raised position, the locking member in its release position sits axially between the first and second locking features, the relative axial position of the locking member and the second locking feature being such that sliding the upper wand upwards engages the locking member with the second locking feature before the lower wand section can slide out of keying engagement with the inlet duct assembly.

* * * * *